US005810083A

United States Patent [19]

Kilgore

[11] Patent Number: 5,810,083

[45] Date of Patent: Sep. 22, 1998

[54] RETRIEVABLE ANNULAR SAFETY VALVE SYSTEM

[75] Inventor: Marion D. Kilgore, Dallas, Tex.

[73] Assignee: Halliburton Energy Services, Inc., Dallas, Tex.

[21] Appl. No.: 758,117

[22] Filed: Nov. 25, 1996

[51] Int. Cl.[6] ..... E21B 34/10

[52] U.S. Cl. ..... 166/120; 166/129; 166/133; 166/183; 166/321

[58] Field of Search ..... 166/120, 129, 166/130, 133, 183, 319, 321, 334.1, 334.4

[56] References Cited

U.S. PATENT DOCUMENTS

| | | | |
|---|---|---|---|
| 4,423,782 | 1/1984 | Bowyer | 166/321 |
| 4,467,867 | 8/1984 | Baker | 166/321 X |
| 4,586,569 | 5/1986 | Hyde | 166/188 X |
| 4,844,166 | 7/1989 | Going, III et al. | 166/379 |
| 5,329,999 | 7/1994 | White et al. | 166/129 |
| 5,505,263 | 4/1996 | White et al. | 166/319 X |

FOREIGN PATENT DOCUMENTS 2235938 3/1991 United Kingdom .

2282616 4/1995 United Kingdom .

*Primary Examiner*—George A. Suchfield

*Attorney, Agent, or Firm*—William M. Imwalle; Paul I. Herman; Marlin Smith

[57] ABSTRACT

An annular safety valve system provides a retrievable annular safety valve and packer. In a preferred embodiment, an annular safety valve system has an annular safety valve connected to an upper tubing string extending to the earth's surface. The annular safety valve is initially connected to the hydraulically set packer which has no openings through an inner mandrel thereof. The safety valve is retrievable separate from the packer after the packer has been set. The safety valve is rotated relative to the packer in order to release the safety valve from the packer. As the safety valve is rotated, a setting line of the packer is severed. Other transmission lines, electrical wires, etc. may be severed as well. The safety valve may then be raised to the earth's surface with the tubing above it. A replacement safety valve is also provided for installing in the packer after the prior safety valve is retrieved.

22 Claims, 17 Drawing Sheets

RETRIEVABLE ANNULAR SAFETY VALVE SYSTEM

BACKGROUND OF THE INVENTION

The present invention relates generally to apparatus utilized in subterranean wells and, in a preferred embodiment thereof, more particularly provides a retrievable annular safety valve system.

Annular safety valves are well known in the art. They are principally utilized in gas lift operations in subterranean wells. In a gas lift operation, gas, such as petroleum gas, is flowed from the earth's surface to gas valves positioned near a producing formation intersected by a well. The gas valves are typically installed in production tubing extending to the earth's surface and permit the gas to flow from an annulus between the tubing and the wellbore to the interior of the tubing. Once inside the tubing, the gas rises, due to its buoyancy, and carries fluid from the formation to the earth's surface along with it.

Since the gas is pumped from the earth's surface to the gas valves through the annulus, it is highly desirable, from a safety standpoint, to install a valve in the annulus. The valve is commonly known as an annular safety valve. Its function is to control the flow of fluids axially through the annulus. In virtually all cases, the annular safety valve is designed to fail closed, that is, to close when a failure or emergency has been detected.

One type of annular safety valve is a control line-type annular safety valve. Fluid pressure in a small tubing (i.e., a control line) connected to the annular safety valve maintains the valve in its open position (permitting fluid flow axially through the annulus) against a biasing force exerted by a spring. If the fluid pressure is lost, such as, if the control line is cut, the valve is closed by the spring biasing force. Thus, the annular safety valve fails closed.

In gas lift operations, the annular safety valve is typically positioned near the earth's surface, so that, if a blowout, fire, etc. occurs, the annular safety valve may be closed. In this manner, the gas already flowed into the annulus below the safety valve will not be permitted to flow upward through the annular safety valve to the earth's surface where it might further feed a fire.

Since an annular safety valve is typically utilized for its intended purpose only when an emergency occurs, it may remain in its open position for an extended period of time. In its open position, corrosive or abrasive fluid may flow over the safety valve's sealing surfaces, continually degrading them. Additionally, dirt and debris may infiltrate the safety valve. These and other factors may contribute to improper functioning of the safety valve when it is called upon to operate in an emergency situation.

For this reason, annular safety valves are periodically tested by well operators to ensure that they are functioning properly. In the past, when an annular safety valve has been found to be defective, the entire tubing string in which it was installed has been raised to the earth's surface so that the safety valve could be replaced or repaired. This operation is time-consuming and expensive.

From the foregoing, it can be seen that it would be quite desirable to provide an annular safety valve system which does not require the entire tubing string to be raised in order to retrieve the safety valve. Additionally, it would be desirable to provide the annular safety valve system with a control line set packer which releasably connects to the safety valve, so that the advantages of a hydraulically set packer may be acquired without the need for ports in the packer's inner mandrel. It would also be desirable to provide the annular safety valve and packer as a unitized assembly. Still further, it would be desirable to provide the annular safety valve system with provision for connection and disconnection of fluid conduits, electrical connections, etc. from above to below the packer, so that pressure gauges, temperature gauges, and other instruments installed below the packer may be in communication with the earth's surface. Furthermore, it would be quite desirable for the packer to be easily retrievable apart from, or in conjunction with, the safety valve. Accordingly, it is an object of the present invention to provide such an annular safety valve system.

SUMMARY OF THE INVENTION

In carrying out the principles of the present invention, in accordance with an embodiment thereof, an annular safety valve system is provided which includes a retrievable and replaceable safety valve. The safety valve may be easily retrieved without raising the entire production tubing string, and without the necessity of unsetting a packer portion of the system. Additionally, the retrievable safety valve is capable of disconnecting transmission lines connected to the packer portion and/or instruments below the packer before it is retrieved. The replacement safety valve may be easily reconnected to the packer portion, and includes features which aid wellsite operations.

In broad terms, apparatus for utilization in a subterranean wellbore is provided. The apparatus includes a packer portion and a valve portion.

The packer portion is configured for atttachment to a lower tubular string, which is suspended below the packer portion and may include instruments, gauges, etc. Preferably, the packer portion is of the type settable by fluid pressure applied via a packer setting line extending to the earth's surface. The packer portion is capable of sealingly engaging the lower tubular string and the wellbore to thereby prevent fluid flow therebetween, but it also includes a fluid passage which communicates with the annulus radially between the lower tubular string and the wellbore.

The valve portion is configured for attachment to an upper tubular string. It is releasably attached to the packer portion. The valve portion is capable of selectively permitting fluid flow from an annulus radially between the valve portion and the wellbore, and the annulus radially between the lower tubular string and the wellbore. The releasable attachment between the valve portion and the packer portion preferably includes a left-hand threaded connection. In this manner, the uupper tubular string and the valve portion may be retrieved from the well by rotating to the right a sufficient number of turns and raising the valve portion and upper tubular string to the earth's surface, while leaving the packer portion set in the wellbore.

Also provided by the present invention is an annular safety valve for use in conjunction with a packer, the packer being settable within a subterranean wellbore. The packer has a first sealing surface and a first axial engagement surface formed thereon, inner and outer diameters, and a first axially extending fluid passage formed radially between the inner and outer diameters. In a disclosed embodiment, the annular safety valve may be connected to the packer while the packer is set in the wellbore.

The annular safety valve includes a second sealing surface, a second axial engagement surface, and a second fluid passage. The second sealing surface is configured for cooperative sealing engagement with the first sealing surface. The second axial engagement surface is positioned relative to the second sealing surface, such that the second axial engagement surface axially engages the first axial engagement surface when the second sealing surface sealingly engages the first sealing surface. The second fluid passage is positioned relative to the second sealing surface, such that the second fluid passage is in fluid communication with the first fluid passage when the second sealing surface sealingly engages the first sealing surface.

Preferably, the first axial engagement surface is formed on a left-hand threaded member on the packer, and the second axial engagement surface is formed on a mating left-hand threaded member on the annular safety valve. The threaded member on the annular safety valve has its threads formed on axially elongated and radially flexible fingers, so that the safety valve can be engaged with the packer by axially inserting it therein, without the necessity of rotating the safety valve.

Other features, benefits, objects, and advantages of the present invention will become apparent upon consideration of the detailed description and appended claims hereinbelow.

DETAILED DESCRIPTION

Figure 1A:
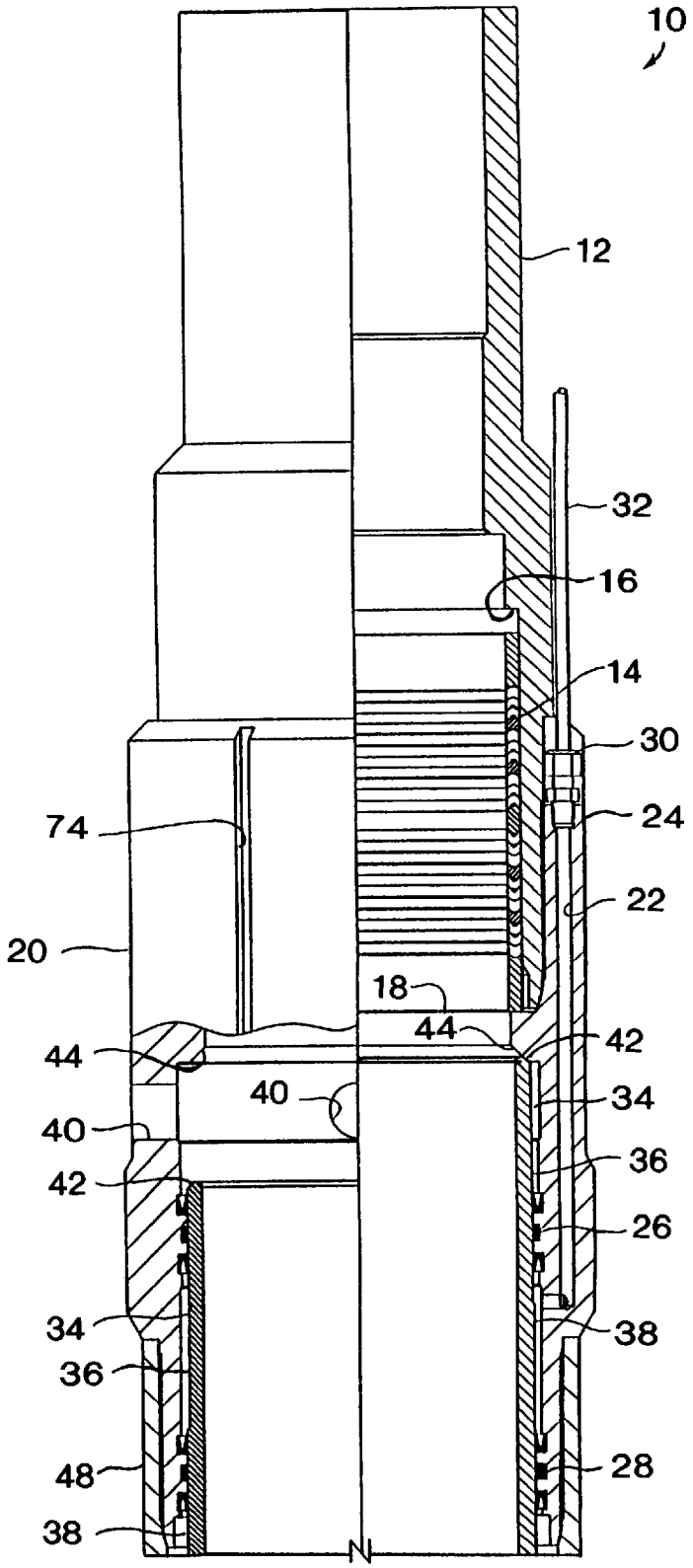
FIGS. 1A–1B are partially cross-sectional and partially elevational views of successive axial portions of a first annular safety valve embodying principles of the present invention.
Figure 1B:
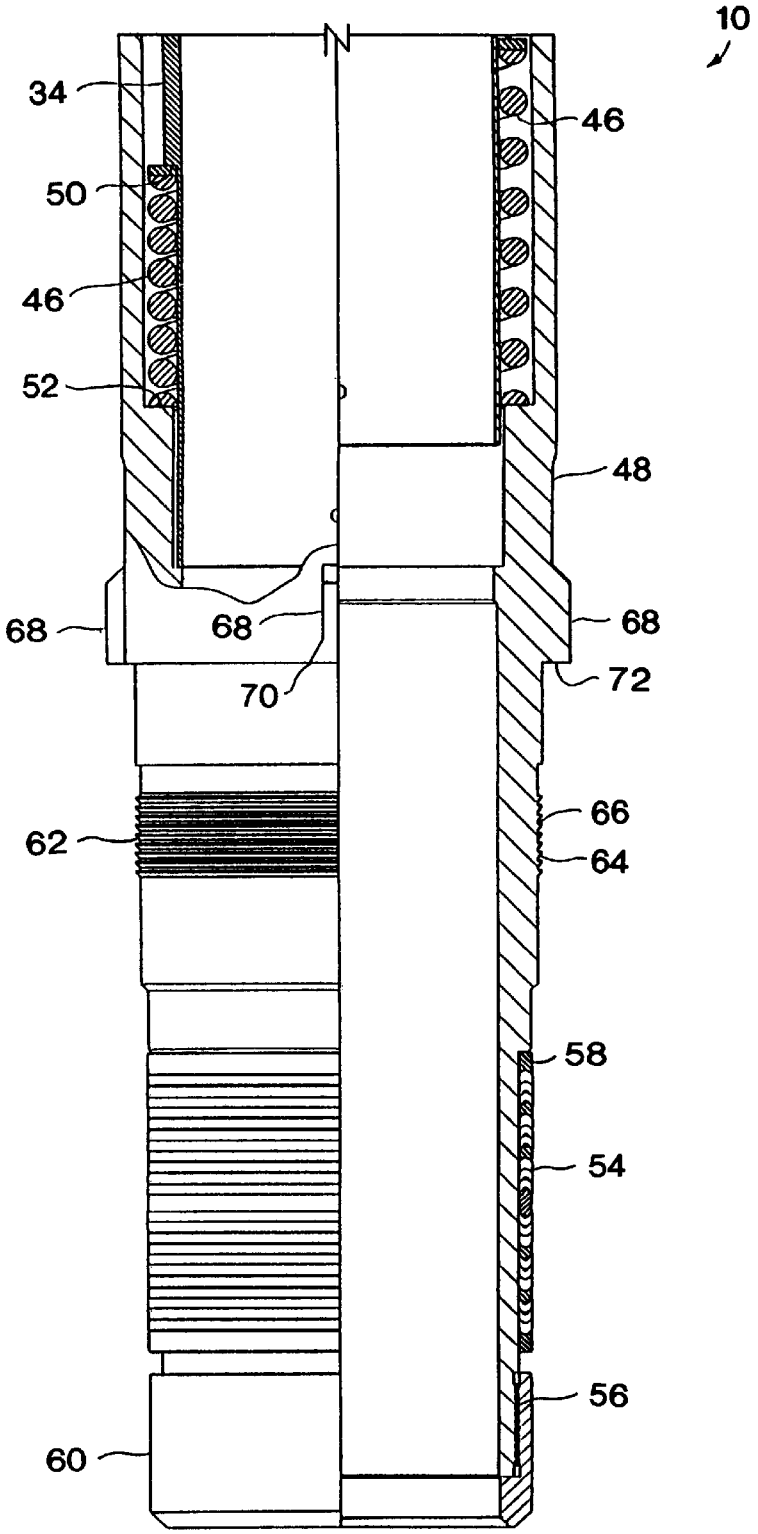

Illustrated in FIGS. 1A–1B is a retrievable annular safety valve 10 which embodies principles of the present invention. It is to be understood that the safety valve 10 is a continuous assembly, although it is representatively illustrated in separate figures herein for clarity of description. It is also to be understood that directional terms, such as "upper", "lower", "upward", "downward", etc. are used herein to refer to the various embodiments of the present invention as they are depicted in the accompanying figures, and that the embodiments of the present invention may be utilized in various orientations, including vertical, horizontal, inclined, inverted, etc.

The safety valve 10 includes a generally tubular top sub 12. The top sub 12 is utilized to attach the safety valve 10 to an upper tubing string (not shown) for conveying the safety valve into a subterranean well. For this purpose, the top sub 12 is preferably provided with suitable internal or external tapered threads of the type well known to those of ordinary skill in the art. For example, the top sub 12 may have EUE 8RD threads formed thereon. Alternatively, other means of connecting the top sub 12 may be utilized.

Internally and sealingly disposed within the top sub 12 is a set of circumferential packing rings 14. The packing 14 is axially contained between an internal shoulder 16 formed on the top sub 12 and an internal shoulder 18 formed on a generally tubular piston housing 20. The piston housing 20 is threadedly secured to the top sub 12.

The piston housing 20 includes, in a sidewall portion thereof, a flow passage 22 which extends internally from an upper end 24 of the piston housing 20 to the interior of the piston housing axially between two axially spaced apart circumferential seals 26, 28. A conventional tube fitting 30 connects a relatively small diameter control line 32 to the piston housing 20, so that the control line 32 is in fluid communication with the flow passage 22. The tube fitting 30 is threadedly and sealingly attached to the piston housing 20. Note that the piston housing 20 also may include one or more axially extending slots 74 externally formed thereon, for containment of other fluid lines, electrical lines, conduits, tubes, wires, or other transmission lines.

When operatively installed in a well, the control line 32 extends to the earth's surface and is conventionally secured to the upper tubing string with, for example, straps at suitable intervals. Fluid pressure may be applied to the control line 32 at the earth's surface with a pump. When sufficient fluid pressure has been applied to the control line 32, a generally tubular piston 34 axially slidingly disposed within the piston housing 20 is forced to displace axially downward.

Fluid pressure in the flow passage 22 causes downward displacement of the piston 34 because the upper seal 26 sealing engages an outer diameter 36 formed on the piston that is relatively smaller than an outer diameter 38 sealingly engaged by the lower seal 28. Thus, a differential piston area is formed between the diameters 36, 38. For this reason, seal 26 is also relatively smaller than seal 28.

FIGS. 1A and 1B show the piston 34 axially downwardly displaced on the left, and axially upwardly displaced on the right of centerline. When the piston 34 is axially downwardly displaced, fluid flow is permitted between the exterior of the safety valve 10 and the interior of the safety valve through a set of radially extending and circumferentially spaced apart ports 40 formed through the piston housing 20. Thus, when the safety valve 10 is disposed within the wellbore, fluid communication is provided by the ports 40 from an annulus formed radially between the wellbore and the safety valve to the interior of the safety valve.

When the piston 34 is axially upwardly, displaced, as shown on the right in FIGS. 1A and 1B, an upper circumferential sealing surface 42 formed on the piston sealingly engages a complementarily shaped sealing surface 44 formed on the piston housing 20. Such sealing engagement between the sealing surfaces 42, 44 prevents fluid communication between the exterior and interior of the safety valve 10 through the ports 40. Note that each of the sealing surfaces 42, 44 are representatively illustrated as being formed of metal, but it is to be understood that other sealing surfaces, such as elastomeric, could be utilized without departing from the principles of the present invention.

Thus, when sufficient fluid pressure is applied to the control line 32 to downwardly displace the piston 34 relative to the piston housing 20, the safety valve 10 is in its "open" configuration, fluid flow being permitted between its interior and exterior through the ports 40. When, however, fluid pressure in the control line 32 is insufficient to downwardly displace or maintain the piston 34 downwardly displaced from the sealing surface 44, the safety valve 10 is in its "closed" position, sealing engagement between the sealing surfaces 42, 44 preventing fluid communication between its interior and exterior through the ports 40.

The piston 34 is axially upwardly biased by a compression spring 46. Thus, in order to axially downwardly displace the piston 34 relative to the piston housing 20, fluid pressure applied to the control line 32 and acting on the differential piston area between the diameters 36, 38 must produce a force oppositely directed to, and greater than, that exerted by the spring 46. Note that biasing members other than the spring 46 may be utilized in the safety valve 10 without departing from the principles of the present invention, for example, the spring could be replaced by a chamber of compressible gas, such as nitrogen.

The piston housing 20 is threadedly attached to a generally tubular and axially extending outer housing 48. The spring 46 is axially compressed between a shoulder 50 externally formed on the piston 34 and a shoulder 52 internally formed on the outer housing 48. The outer housing 48 carries a set of packing rings 54 externally thereon near a lower end 56 thereof. The packing 54 is axially contained between a shoulder 58 externally formed on the outer housing 48 and an end cap 60, which is threadedly attached to the lower end 56.

The outer housing 48 also has threads 62 externally formed thereon. For purposes that will become apparent upon consideration of the further detailed description hereinbelow, applicant prefers that the threads 62 be of the type well known to those of ordinary skill in the art as left-hand threads. Further, applicant prefers that the threads 62 have an inclined lower face 64 and a flat (or laterally extending as viewed in FIG. 1B) upper face 66. The lower faces 64 are, thus, similar to a series of axially spaced apart and circumferentially extending "ramps". Such thread type is also known as "buttress" threads.

The outer housing 48 also includes a series of four radially outwardly extending and circumferentially spaced apart blades 68 formed externally thereon, only three of which are visible in FIG. 1B. Each of the blades 68 has a circumferentially inclined cutting edge 70 formed thereon, the cutting edges corresponding to an intersection of the blades 68 with an external shoulder 72 formed on the outer housing 48. Applicant prefers that the cutting edges be hardened by a process such as flame-hardening where the outer housing 48 is made of steel, but it is to be understood that it is not necessary to harden the cutting edges, and that other hardening processes may be utilized, without departing from the principles of the present invention.

Turning now to FIGS. 2A–2D, a packer 76 designed for cooperative engagement with the safety valve 10 of FIGS. 1A–1B in a retrievable annular safety valve system of the present invention is representatively illustrated. It is to be understood that the packer 76 is a continuous assembly, although it is shown in a succession of separate figures. The packer 76 includes an axially upwardly extending generally tubular inner mandrel 78, which has a polished outer diameter 80 cooperatively shaped for sealing engagement with the packing 14 of the safety valve 10. Thus, when the inner mandrel 78 is inserted axially slidingly within the top sub 12, the outer diameter 80 sealingly engages the packing 14. Such cooperative engagement between the inner mandrel 78 and the safety valve 10 is representatively illustrated in FIG. 3A.

The packer 76 includes an axially extending generally tubular upper housing 82, which has a polished inner diameter 84 formed therein. The inner diameter 84 is cooperatively shaped for sealing engagement with the packing 54, so that when the outer housing 48 is inserted axially into the upper housing 82, the inner diameter 84 slidingly and sealingly engages the packing 54. Such cooperative engagement is representatively illustrated in FIG. 3B.

The upper housing 82 also includes threads 86 internally formed therein. The threads 86 are complementarily shaped relative to the threads 62 on the outer housing 48. Thus, the safety valve 10 may be attached to the packer 76 by rotational engagement of the threads 62, 86. Since the threads 62, 86 are preferably left-handed, engagement of the threads is by counter-clockwise rotation of the safety valve 10 relative to the packer 76 as viewed from above, and disengagement is by clockwise rotation. In this manner, the safety valve 10 may be conveniently disengaged from the packer 76 by clockwise rotation of the upper tubing string at the earth's surface, without causing loosening of threaded connections in the tubing string, since the tubing string threaded connections are, in typical practice, right-handed.

The upper housing 82 includes a series; of axially extending slots 88 externally formed thereon. Contained in an axially aligned pair of the slots 88 is a packer setting line 90, which is similar to the control line 32 of the safety valve 10. However, the packer setting line 90 is utilized to conduct fluid pressure from the earth's surface to a piston 92 for setting the packer 76 in the wellbore. When the packer 76 is cooperatively engaged with the safety valve 10, such as when the safety valve and packer are conveyed initially into the wellbore, the packer setting line 90 is also disposed within one of the slots 74 formed on the piston housing 20.

The upper housing 82 is threadedly attached to an axially extending generally tubular intermediate housing 94. A circumferential seal 96 externally carried on the intermediate housing 94 sealingly engages the upper housing 82 at the threaded connection therebetween. The inner mandrel 78 is secured against axial displacement relative to the upper and intermediate housings 82, 94 by a collar 98 threadedly attached externally to the inner mandrel and axially captured between the upper and intermediate housings at the threaded connection therebetween. A pin 100 installed radially through the collar 98 and partially into the inner mandrel 78 prevents relative rotation between the collar and inner mandrel.

The packer setting line 90 is secured to the intermediate housing 94 by a conventional tube fitting 102. The packer setting line 90 extends from the exterior of the intermediate housing 94 to the interior of the intermediate housing through an opening 104 formed therethrough. From the opening 104, the packer setting line 90 extends axially downward, radially between the inner mandrel 78 and the intermediate housing 94.

Figure 2A:
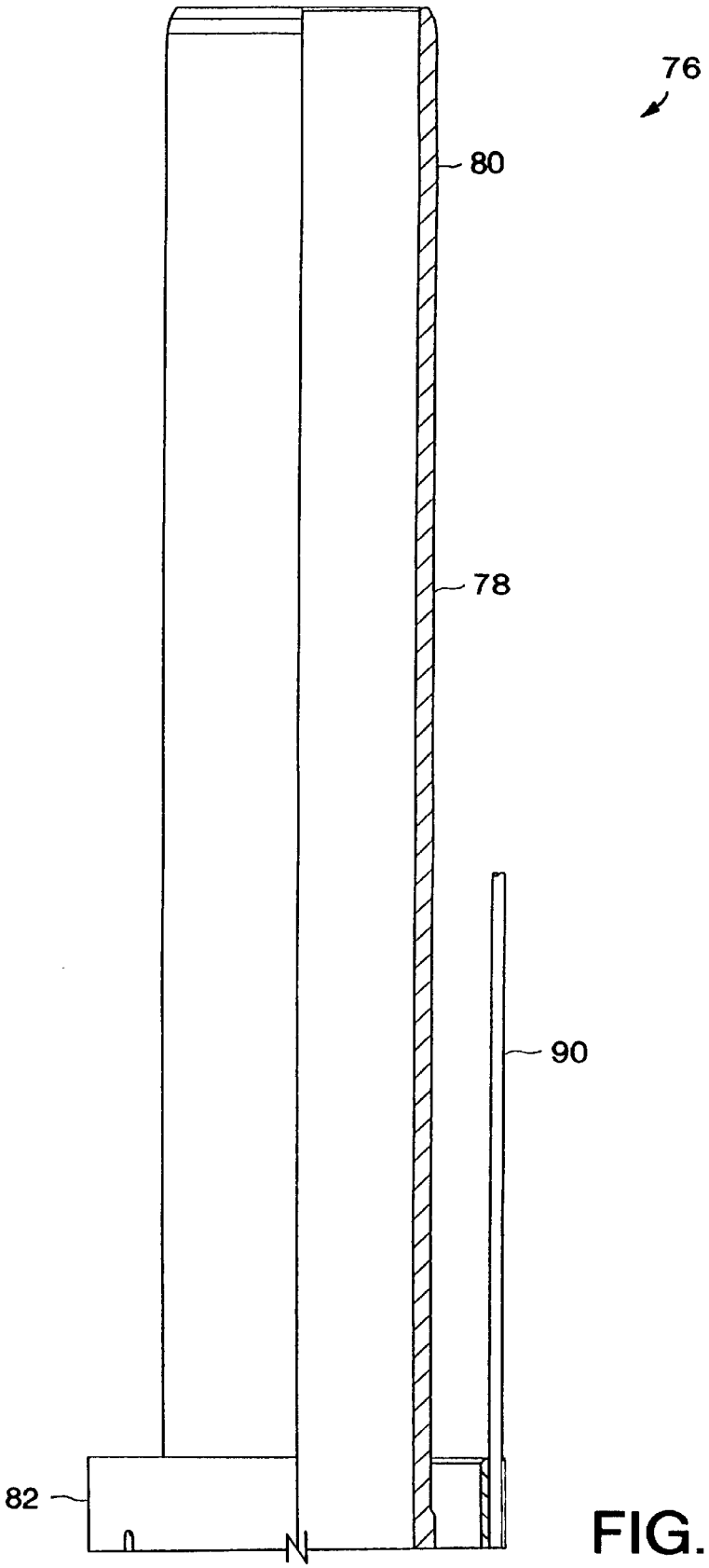
FIGS. 2A–2D are partially cross-sectional and partially elevational views of successive axial portions of a packer embodying principles of the present invention, the packer being specially configured for engagement with each of the annular safety valves disclosed herein.
Figure 2B:
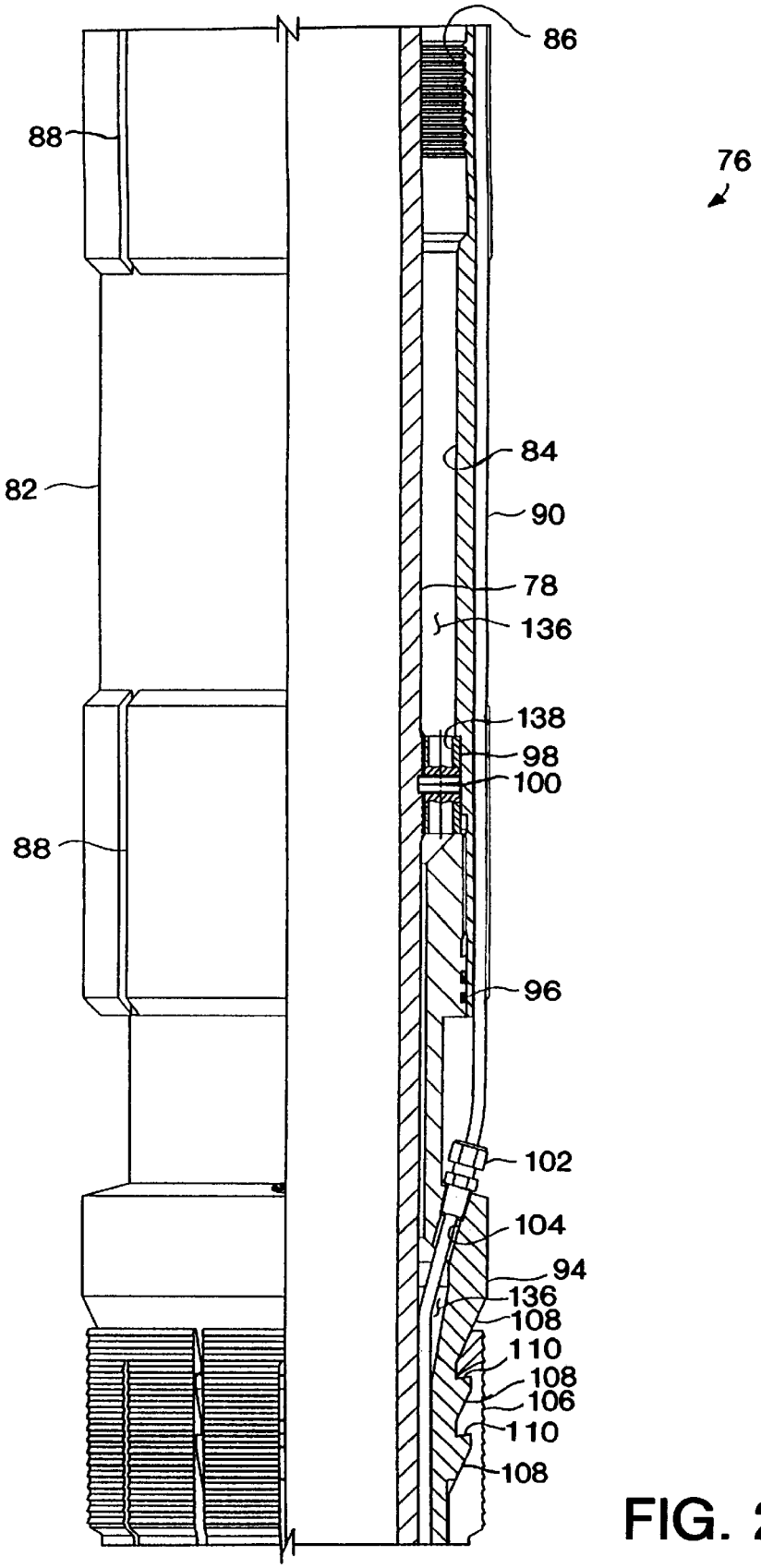
Figure 2C:
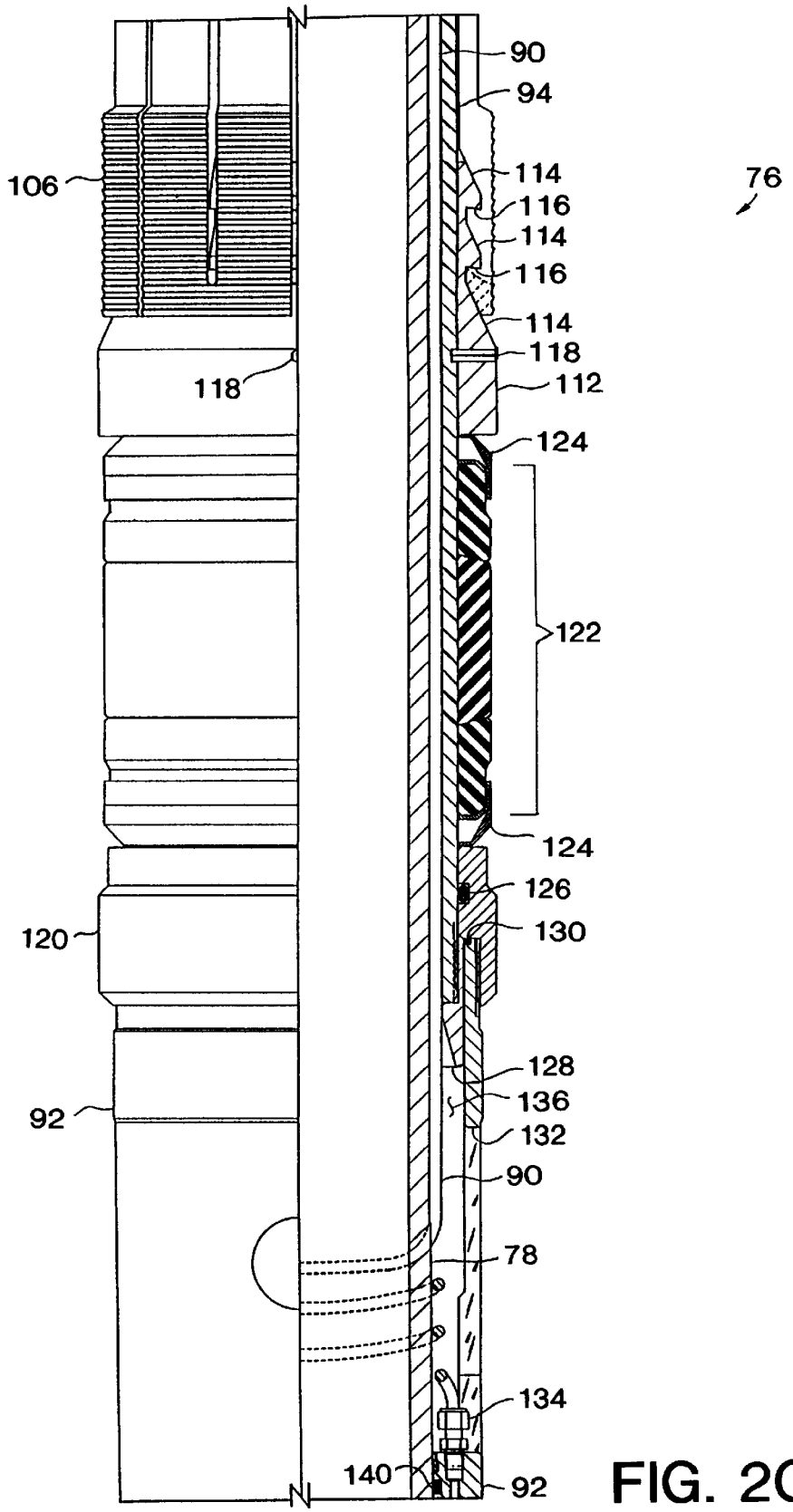
Figure 3A:
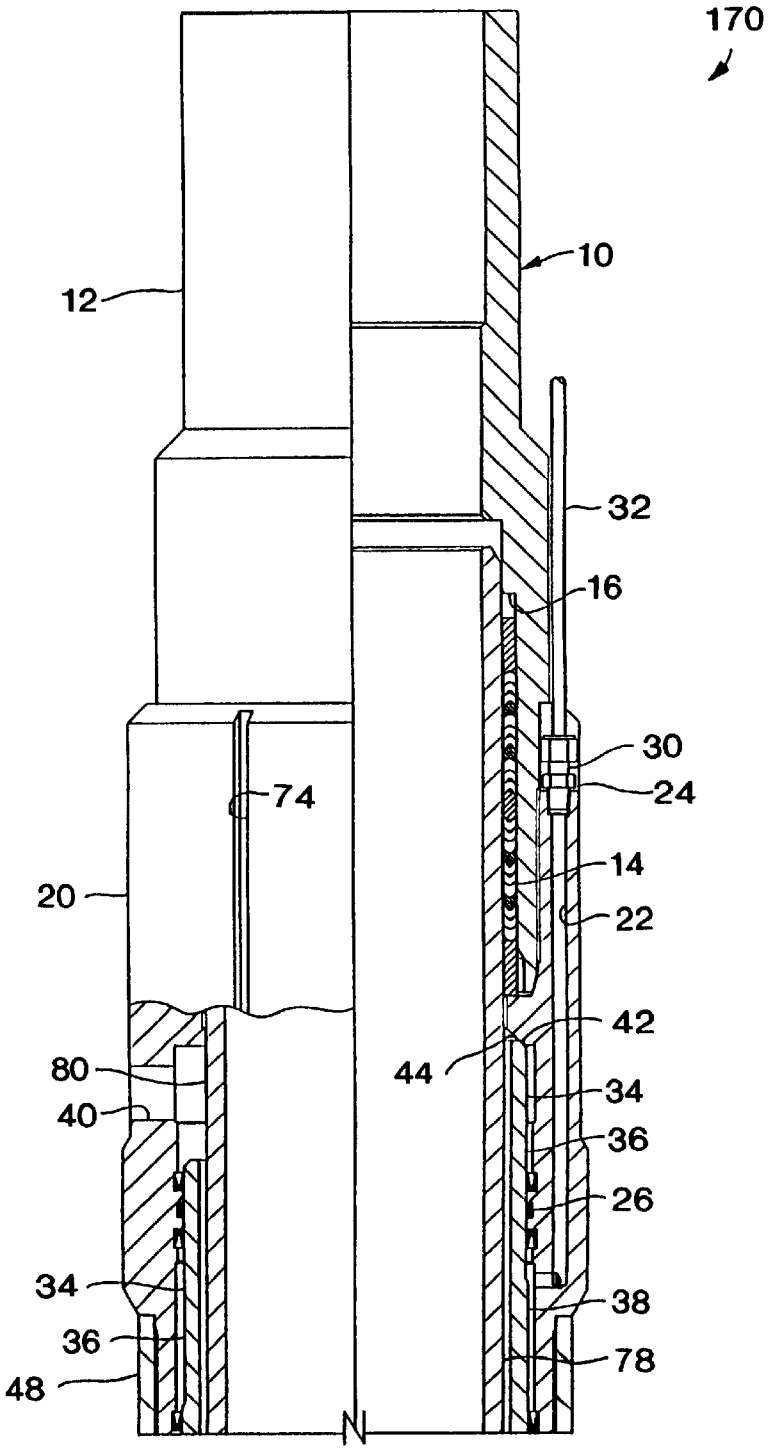
FIGS. 3A–3E are partially cross-sectional and partially elevational views of successive axial portions of the first annular safety valve of FIGS. 1A–1B operatively engaged with the packer of FIGS. 2A–2D.

Slips 106, of the type well known to those of ordinary skill in the art as "barrel" slips, are externally carried on the intermediate housing 94. The intermediate housing 94 has radially inclined axially opposing ramp surfaces 108, 110 externally formed thereon for alternately urging the slips 106 radially outward to grippingly engage the wellbore when the packer 76 is set therein, and retracting the slips radially inward when the packer is conveyed axially within the wellbore. As shown in FIG. 2B, the faces 110 on the intermediate housing 94 are maintaining the slips 106 in their radially inwardly retracted positions. Note that other types of slips may be utilized on the packer 76 without departing from the principles of the present invention.

A generally tubular upper element retainer 112 is axially slidingly carried externally on the intermediate housing 94. The upper element retainer 112 has, similar to the intermediate housing 94, radially inclined and axially opposing ramp surfaces 114, 116 formed thereon. The upper element retainer 112 is releasably secured against axial displacement relative to the intermediate housing 94 by a series of four circumferentially spaced apart shear pins 118 installed radially through the upper element retainer and partially into the intermediate housing.

A generally tubular lower element retainer 120 is axially slidingly disposed externally on the intermediate housing 94. The upper and lower element retainers 112, 120 axially straddle a set of conventional seal elements 122, with a conventional backup shoe 124 being disposed axially between the seal elements and each of the element retainers. A circumferential seal 126 internally carried on the lower element retainer sealingly engages the intermediate housing 94.

The lower element retainer 120 is prevented from displacing axially downward on the intermediate housing 94 by an end cap 128, which is threadedly attached to the intermediate housing. The generally tubular and axially extending piston 92 radially outwardly overlies the end cap 128 and is threadedly attached to the lower element retainer 120. A circumferential seal 130 sealingly engages the lower element retainer 120, the piston 92, and the end cap 128 as viewed on FIG. 2C.

A window 132 formed radially through the piston 92 permits access to the packer setting line 90, and to a conventional tube fitting 134 which connects the packer setting line to the piston. The packer setting line 90 is wrapped spirally about the inner mandrel 78, within the piston 92, so that, when the piston displaces axially relative to the inner mandrel 78, the packer setting line will be capable of flexing to compensate for the axial displacement without breaking.

The window 132 also provides fluid communication between the exterior of the packer below the seal elements 122 and the interior of the intermediate housing 94. Note that a flow passage 136 extends axially upward from the window 132, through the interior of the intermediate housing 94, through axially extending holes 138 formed through the collar 98 and into the interior of the upper housing 82. The flow passage 136 is radially inwardly bounded by the inner mandrel 78. When the safety valve 10 is cooperatively engaged with the packer 76, the flow passage is in fluid communication with the ports 40 if the safety valve is in its open configuration. If the safety valve 10 is in its closed configuration, such fluid communication is not permitted by sealing engagement of the sealing surfaces 42, 44.

Thus, it may be easily seen that, with the packer 76 set in the well, so that the seal elements 122 sealingly engage the wellbore, the upper annulus between the safety valve 10 and the wellbore is in fluid communication with the lower annulus between the packer below the seal elements and the wellbore when the safety valve is open, and the upper annulus is not in fluid communication with the lower annulus when the safety valve is closed. It may also be seen that the safety valve 10 fails closed, to thereby shut off fluid communication between the upper and lower annulus, when fluid pressure in the control line 32 is released. Furthermore, it may be seen that the interior of the inner mandrel 78, the interior of the upper tubing string attached to the safety valve top sub 12, and the interior of any tubing string attached below the packer 76 are isolated from the upper and lower annulus in the safety valve 10 and the packer 76.

To set the packer 76 in the wellbore, fluid pressure is applied to the packer setting line 90 at the earth's surface. The fluid pressure is transmitted through the packer setting line 90 to the piston 92, which is axially slidingly disposed exteriorly on the inner mandrel 78. A circumferential seal 140 carried internally on the piston 92 sealingly engages the inner mandrel 78. The fluid pressure enters an annular chamber 142 formed radially between the piston 92 and the inner mandrel 78 and axially between the piston and a generally tubular and axially extending lower housing 144.

Figure 2D:
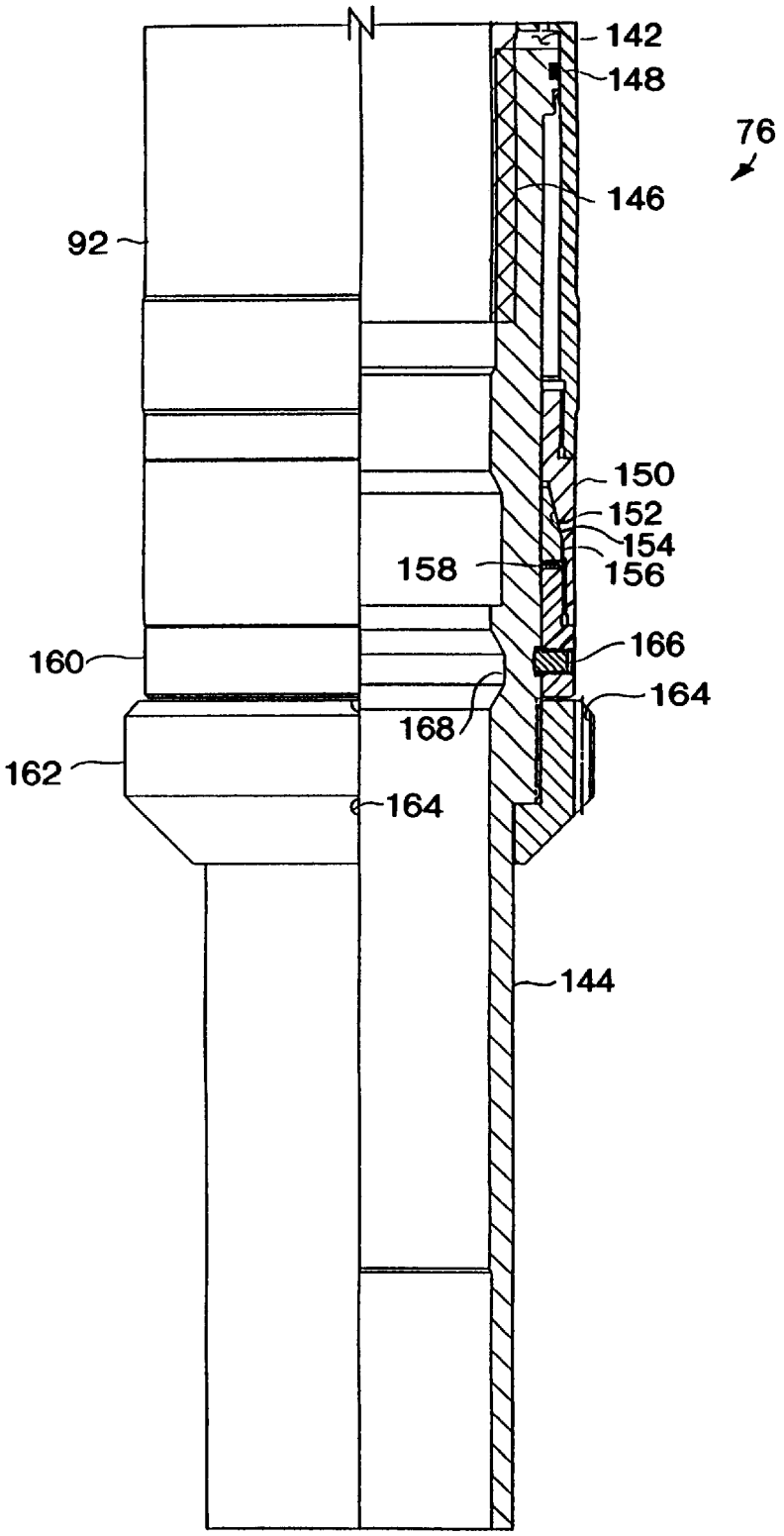

The lower housing 144 is threadedly attached to the inner mandrel 78 at a threaded connection 146 therebetween represented in FIG. 2D by overlapping cross-hatched areas. The threaded connection 146 is preferably a tapered VAM-type connection well known to those of ordinary skill in the art. Alternatively, the lower housing 144 and inner mandrel 78 may be otherwise axially and sealingly attached without departing from the principles of the present invention.

The lower housing 144 carries a circumferential seal 148 externally thereon. The seal 148 sealingly engages an axially extending internal bore formed on the piston 92. Thus, when the fluid pressure enters the chamber 142, the piston 92 is thereby forced axially upward relative to the lower housing 144.

A generally tubular slip housing 150 is threadedly attached to the piston 92. The slip housing 150 has an internal inclined surface 152 formed thereon, which complementarily engages an external inclined surface 154 formed on each of a series of circumferentially disposed internal slips 156 (only one of which is visible in FIG. 2D). The internal slips 156 are biased into contact with the slip housing 150 by a circumferentially wavy spring 158 disposed axially between the slips and a generally tubular slip retainer 160 threadedly attached to the slip housing 150. A collar 162 is threadedly attached to the lower housing 144 axially below the slip retainer 160 to thereby prevent the piston 92, slip housing 150, slip retainer, etc. from axially downwardly displacing relative to the lower housing. The collar 162 is also provided with a series of circumferentially spaced apart and axially extending holes 164 formed therethrough for containment of control lines, electrical lines, wires, tubes, and other transmission lines which may be utilized where instruments, such as pressure gauges, temperature gauges, etc. are to be attached below the packer 76.

When sufficient fluid pressure is applied in the chamber 142, a shear screw 166, which releasably secures the slip retainer 160 against axial displacement relative to the lower housing 144, is sheared, thereby permitting the slip retainer, slips 156, slip housing 150, piston 92, and lower element retainer 120 to displace axially upward relative to the lower housing and inner mandrel 78. The internal slips 156 are internally toothed so that they grippingly engage the lower housing 144. When an axially downwardly directed force is applied to the slip housing 150, the mating inclined surfaces 152, 154 bias the slips 156 radially inward to grip the lower housing 144 and prevent axially downward displacement of the slip housing 150 relative to the lower housing. On the other hand, when an axially upwardly directed force is applied to the slip housing 150, the spring 158 permits the slips 156 to axially displace somewhat downward relative to the slip housing, thereby permitting the slips 156 to radially outwardly disengage from the lower housing 144. Thus, the slip housing 150, slips 156, and slip retainer 160 may displace axially upward relative to the lower housing 144, but are not permitted to displace axially downward relative to the lower housing.

As fluid pressure in the chamber 142 increases, the lower element retainer 120 pushes axially upward against the seal elements 122 and backup shoes 124, which, in turn, push axially upward on the upper element retainer 112. When the fluid pressure is sufficiently great, the shear pins 118 shear and the lower element retainer 112 displaces axially upward relative to the intermediate housing 94. When the lower element retainer 112 displaces axially upward relative to the intermediate housing 94, the axial distance between inclined faces 108 and 114 decreases, thereby forcing the slips 106 radially outward to grippingly engage the wellbore. Soon after the slips 106 grippingly engage the wellbore, the seal elements 122 and backup shoes 124 are axially compressed between the upper and lower element retainers 112, 120, thereby extending the seal elements radially outward to sealingly engage the wellbore.

When the slips 106 grippingly engage the wellbore, and the seal elements 122 sealingly engage the wellbore, the packer 76 is "set" in the wellbore, and the annulus between the packer and the wellbore is effectively divided into upper and lower portions, with the seal elements preventing fluid communication thereacross. However, as noted above, the flow passage 136 may be utilized to provide fluid communication between the upper and lower annulus. The internal slips 156 prevent unsetting of the packer 76 by preventing axially downward displacement of the lower element retainer 120, piston 92, etc. relative to the lower housing 144. Thus, the fluid pressure does not have to be maintained on the packer setting line 90 in order to maintain the packer 76 set in the wellbore.

One advantage of the packer 76 is that it may be further set, so that the slips 106 increasingly grip the wellbore and the seal elements 122 seal tighter against the wellbore, by applying additional or increased fluid pressure to the packer setting line 90. Thus, after the packer 76 has been installed in a wellbore for an extended period of time, or if the packer 76 fails an initial pressure or pull test, and it is desired to further set the packer, pressure may again be applied to the packer setting line 90 for this purpose. Note that, in normal circumstances, after the packer 76 has been initially and successfully set in the wellbore, applicant does not anticipate that it will be necessary to again apply pressure to the packer setting line 90.

An internal latching profile 168 is formed in the lower housing 144 axially below the threaded connection 146. Preferably, the profile 168 is of the type well known to those of ordinary skill in the art which operates in conjunction with a type BO positioning tool manufactured by, and available from, Halliburton Company of Duncan, Okla. If it is desired to unset the packer 76 so that it may be retrieved from the well, a cutting device, such as a chemical cutter, fluid jet cutter, explosive cutter, etc., may be conveyed into the lower housing 144, for example, suspended from a slickline, and the inner mandrel 78 may be cut thereby. The preferred positioning tool may be latched into the profile with the cutter positioned relative to the positioning tool so that the cutter is disposed radially opposite the portion of the inner mandrel 78 to be cut. Note that other positioning methods may be utilized without departing from the principles of the present invention, for example, a no-go profile could be provided instead of the profile 168, a conventional collar locator could be utilized to correlate to the depth of the packer 76, a conventional radioactive pip tag could be located on the packer 76 a predetermined distance from the portion of the inner mandrel 78 to be cut and thereafter detected with a conventional gamma ray detector tool suspended from wireline, etc. The applicant prefers use of the profile 168 since it provides a full bore through the packer 76 and a positive physical locating device for positioning the cutter (which is specially helpful where more than one run of the cutter may be required to completely cut through the inner mandrel 78).

Cutting of the inner mandrel 78 into axial portions achieves unsetting of the packer 76, since the inner mandrel is placed in tension when the piston 92 is displaced axially upward relative to the intermediate housing 94. Recall that the inner mandrel 78 is axially secured relative to the intermediate housing 94 by the collar 98, and that the inner mandrel is axially secured to the lower housing 144, with which the slips 156 grippingly engage. Thus, cutting of the inner mandrel 78 permits the lower element retainer 120 to axially downwardly displace relative to the intermediate housing 94, thereby permitting the slips 106 and seal elements 122 to radially inwardly retract out of engagement with the wellbore.

To unset the packer 76, the inner mandrel 78 should be cut axially between the collar 98 and the threaded connection 146. Note that, in this operation, no debris or other pieces of the packer 76 are left behind in the well when the packer is retrieved therefrom. All parts of the packer 76 are retrieved together as an assembly. The lower housing 144 is preferably provided with threads (not shown) at its lower end for threaded connection of the packer 76 to a tubing string (not shown) below the packer. The threads on the lower housing 144 may be of any of those types well known to those of ordinary skill in the art, such as EUE 8RD threads, VAM threads, etc. Thus, when the packer 76 is retrieved, the lower tubing string is also retrievable therewith.

Referring additionally now to FIGS. 3A–3F, the safety valve 10 and packer 76 are representatively illustrated cooperatively engaged in a retrievable annular safety valve system 170 embodying principles of the present invention. Applicant prefers that the safety valve 10 and packer 76 be cooperatively engaged when the system 170 is initially installed in the well. However, it is to be understood that the safety valve 10 and packer 76 may be separately installed without departing from the principles of the present invention.

Note that, with the threads 62, 86 engaged and tightened so that the upper housing 82 abuts the shoulder 72 of the outer housing 48, the upper packing 14 sealingly engages the inner mandrel 78, and the lower packing 54 sealingly engages the upper housing 82. When the safety valve 10 is open, the flow passage 136, thus, extends from the ports 40 to the window 132, radially inwardly disposed relative to the seal elements 122, so that when the seal elements sealingly engage the wellbore, fluid communication may be achieved selectively between the upper and lower annulus. As described hereinabove, if fluid pressure in the control line 32 is released, or is otherwise insufficient to overcome the biasing force of the spring 46, the sealing surfaces 42, 44 will sealingly engage and close the flow passage 136.

When the system 170 is properly positioned within the wellbore, and it is desired to set the packer 76, fluid pressure is applied to the packer setting line 90. The fluid pressure in the packer setting line 90 is increased sufficiently to set the packer 76 and then, preferably, the packer is tested by applying force and pressure to it. If the packer 76 has not been properly set, the fluid pressure in the packer setting line 90 may be increased to further set the packer, if desired. Once the packer 76 is set, fluid pressure in the packer setting line 90 may be released.

When the packer 76 is properly set, fluid pressure may be applied to the control line 32 to open the safety valve 10. With the safety valve 10 open, operations, such as gas lift operations, may be performed which require fluid communication between the upper and lower annulus. If it is desired to close the safety valve 10, for example, if a fire or other emergency occurs at the earth's surface, the safety valve may be closed by releasing the fluid pressure on the control line 32.

Operation of the safety valve 10 may be periodically tested by, for example, closing the safety valve and applying a predetermined fluid pressure to the upper annulus, and then checking whether or not the fluid pressure varies due to leakage past the sealing surfaces 42, 44. If the safety valve 10 does not close, the safety valve leaks when it is closed, or otherwise malfunctions, it may be desirable to retrieve it to the earth's surface for repair and replacement. Instead of unsetting the packer 76 and raising the entire downhole assembly, including the lower tubing string, the safety valve 10 may be conveniently disengaged from the packer 76 by rotating it to the right (clockwise as viewed from above) to thereby disengage the threads 62, 86, and raising it to the earth's surface.

A feature of the system 170 prevents the packer setting line 90 from interfering with retrieval of the safety valve 10 from the well. Since it is likely that the packer 76 is properly set in the wellbore if it is desired to retrieve the safety valve 10 to the earth's surface separate from the packer, it is also very likely that the packer setting line 90 is no longer needed. Therefore, the system 170 provides for severing of the packer setting line 90, so that the safety valve 10 may be retrieved with the upper portion of the packer setting line.

Figure 3B:
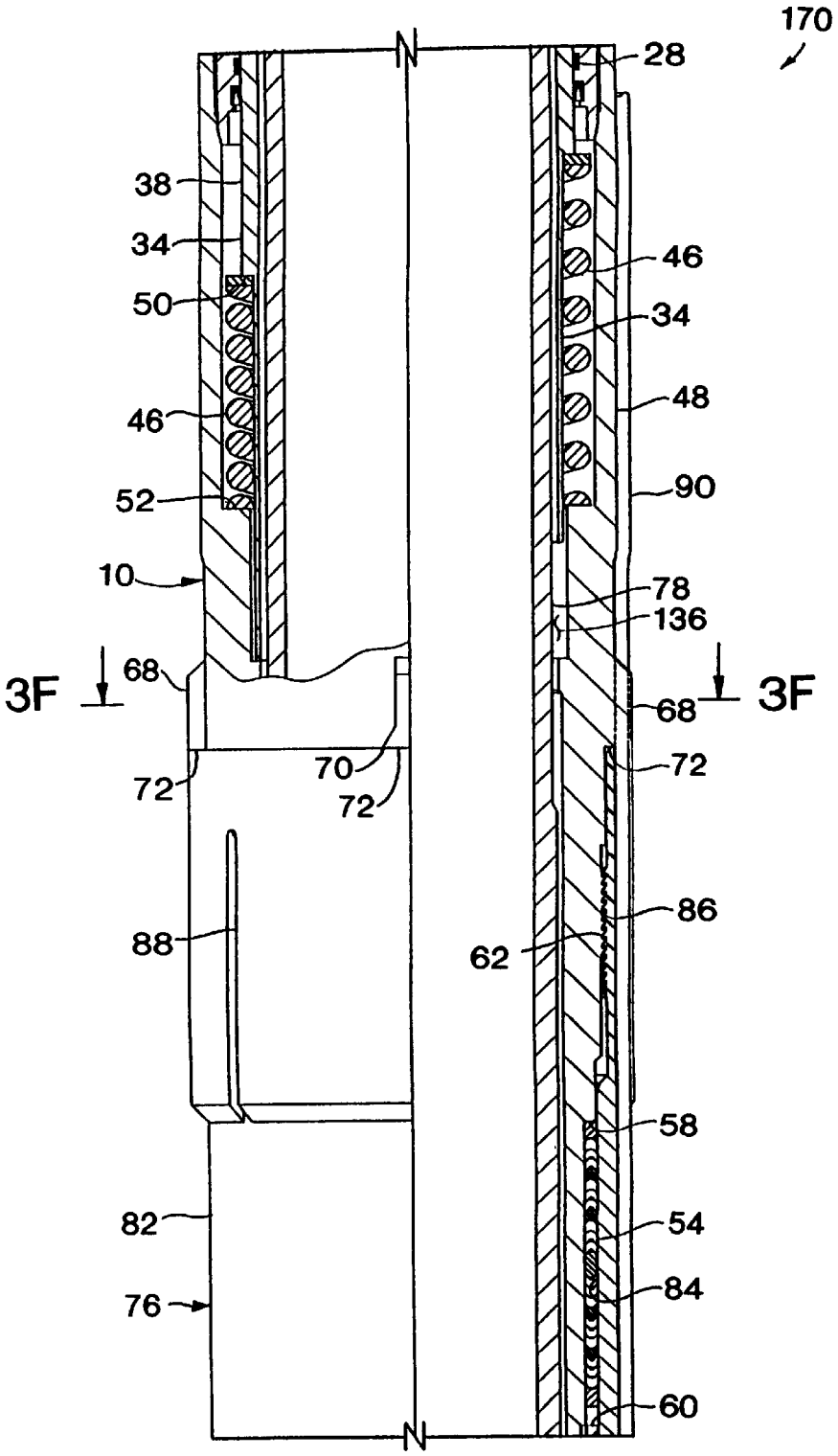
Figure 3C:
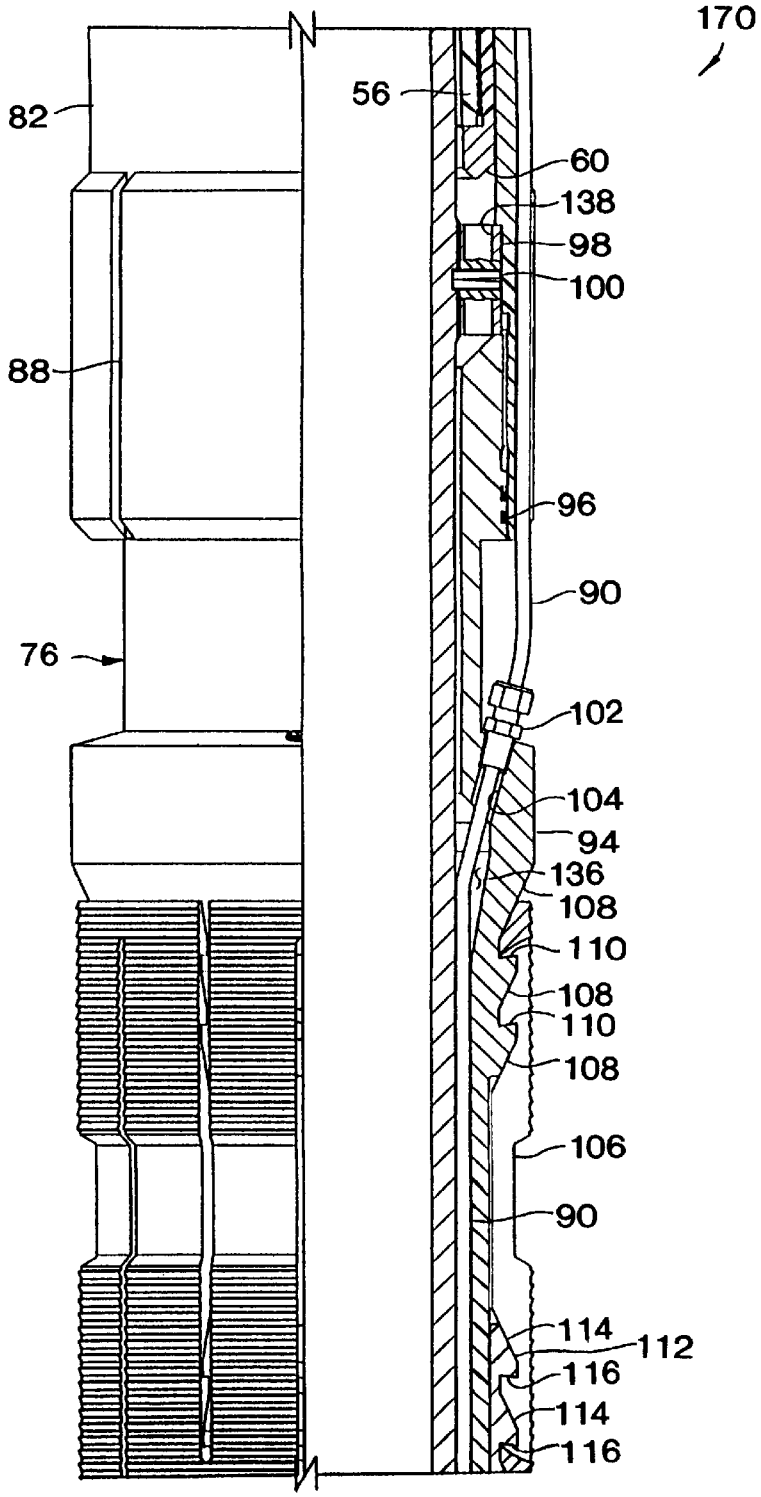
Figure 3D:
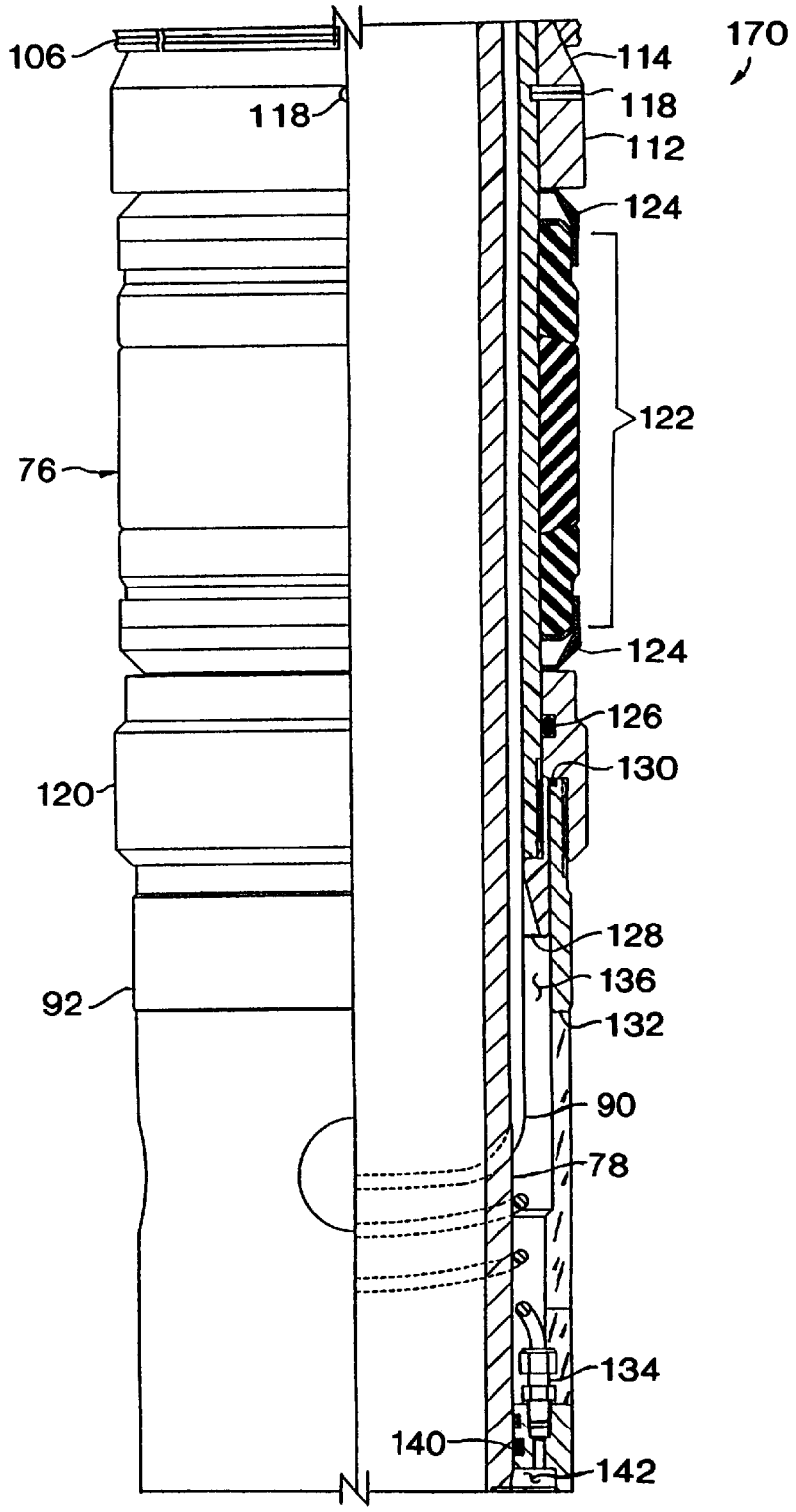
Figure 3E:
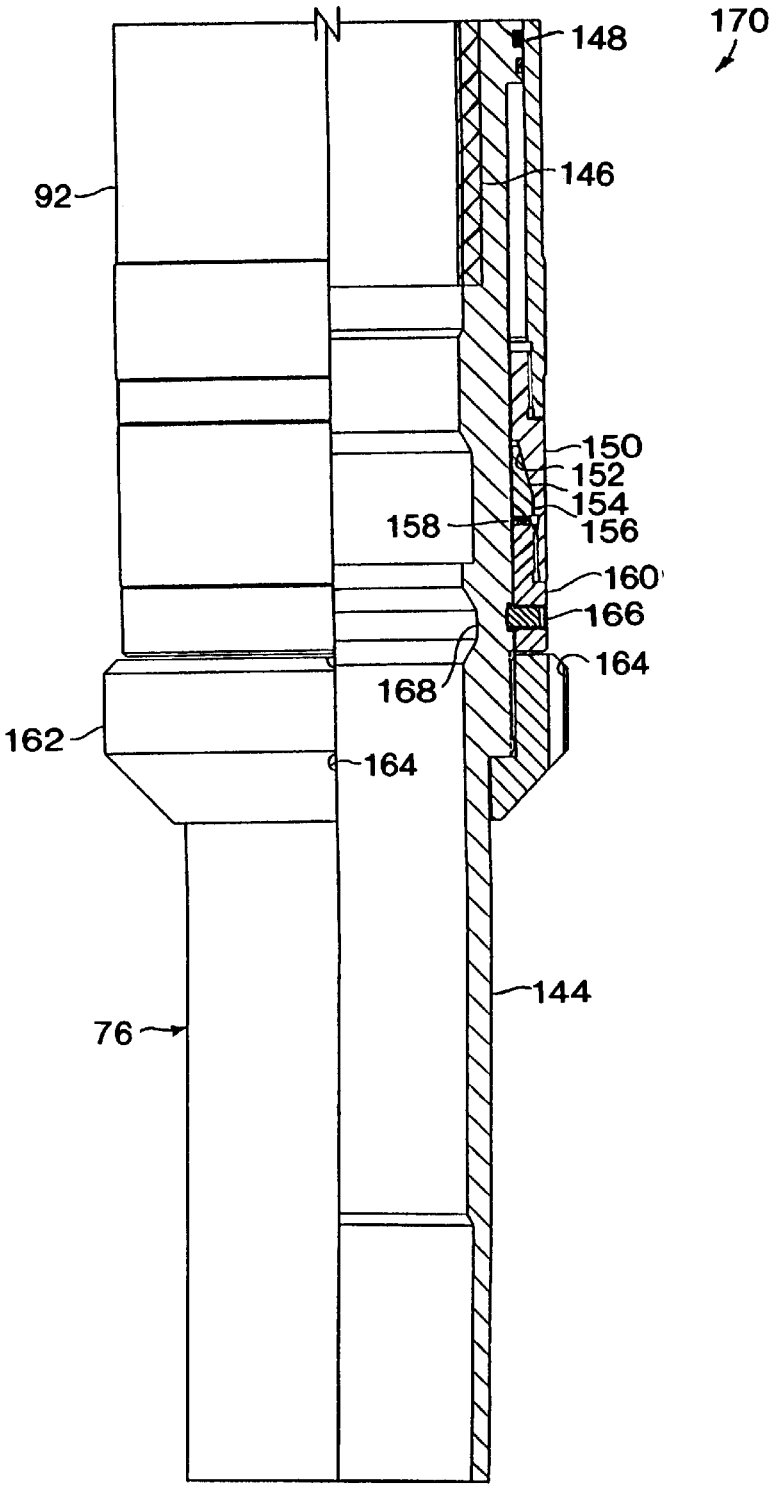
Figure 3F:
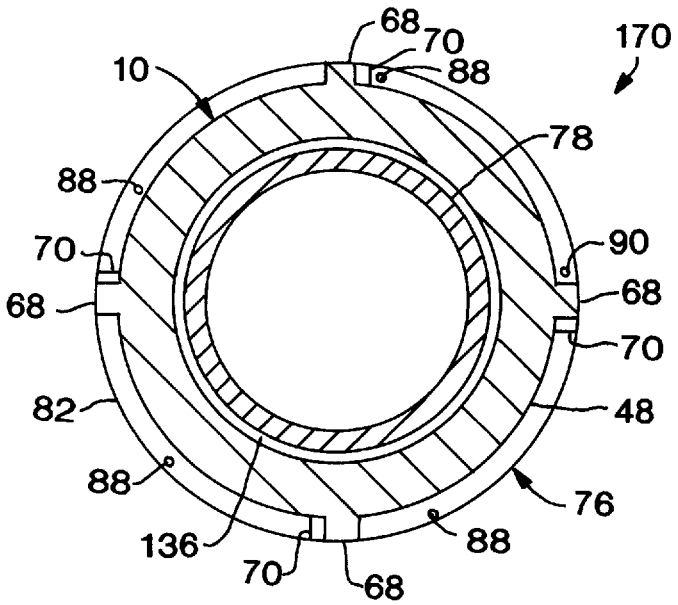
FIG. 3F is a cross-sectional view thereof, taken along line 3F—3F of FIG. 3B.

Referring specifically now to FIGS. 3B and 3F, the packer setting line 90 extends axially upward through one of slots 88 and between a pair of the blades 68 on the outer housing 48. When the safety valve 10 is rotated to the right for retrieval thereof, the cutting edge 70 of one of the blades 68 cuts laterally through the packer setting line 90. Note that, as representatively illustrated in FIG. 3F, there are more slots 88 than there are blades 68. In this case, there are four blades 68 equally circumferentially spaced at 90 degrees apart from each other, and there are five slots 88 (which are preferably axially extending holes at the upper end of the upper housing 82) equally circumferentially spaced at 72 degrees apart from each other. Other quantities of blades 68 and slots 88 may be utilized without departing from the principles of the present invention.

Even if one of the slots 88 is covered by one of the blades 68, the remainder of the slots will remain open. This leaves four open slots 88 for insertion therethrough of the packer setting line 90, and electrical conduits, wires, tubes, or other transmission lines which may be utilized, for example, for instruments attached in the lower tubing string suspended below the packer 76. Note that, due to the preferred unequal number of blades 68 and slots 88, each cutting edge 70 is circumferentially spaced apart counterclockwise (as viewed from above) from a corresponding slot by a different distance than are each of the other corresponding pairs of cutting edges and slots. Thus, as the safety valve 10 is rotated clockwise, only one of the cutting edges 70 will contact one of the transmission lines at a time. The transmission lines, such as the packer setting line 90, etc., are severed in succession in order to reduce the torque required to sever all of the lines when the safety valve 10 is disengaged from the packer 76. Of course, if required torque is of no concern, all of the transmission lines could be severed simultaneously.

Alternatively, the outer housing 48 and upper housing 82 could be provided with mating sealing surfaces, such as face seals, so that when the safety valve 10 is disengaged from the packer 76, the sealing surfaces would also separate, thereby parting transmission lines, such as the packer setting line 90. These and other modifications, within the skill of an ordinarily skilled artisan, are contemplated by the applicant and are within the principles of the present invention.

When the safety valve 10 has been rotated to disengage it from the packer 76 and sever the packer setting line 90 and other transmission lines, the safety valve may be raised and retrieved to the earth's surface along with the upper portions of the packer setting line and other transmission lines. In a unique feature of the present invention, a replacement retrievable annular safety valve 172 may be conveyed into the wellbore and operatively Engaged with the packer 76 (the packer remaining set in the wellbore), thereby enabling normal wellsite operations to resume after retrieval of the first safety valve 10. In another unique feature of the present invention, the replacement safety valve 172 may be operatively engaged with the packer 76 without the necessity of rotating the replacement safety valve. It is undesirable to rotate the replacement safety valve 172, because it has a control line 32*a* attached thereto and extending to the earth's surface, and rotation of the safety valve might cause damage to the control line. However, it is to be understood that the first safety valve 10 could be repaired and replaced in operative engagement with the packer 76 without departing from the principles of the present invention.

Figure 4A:
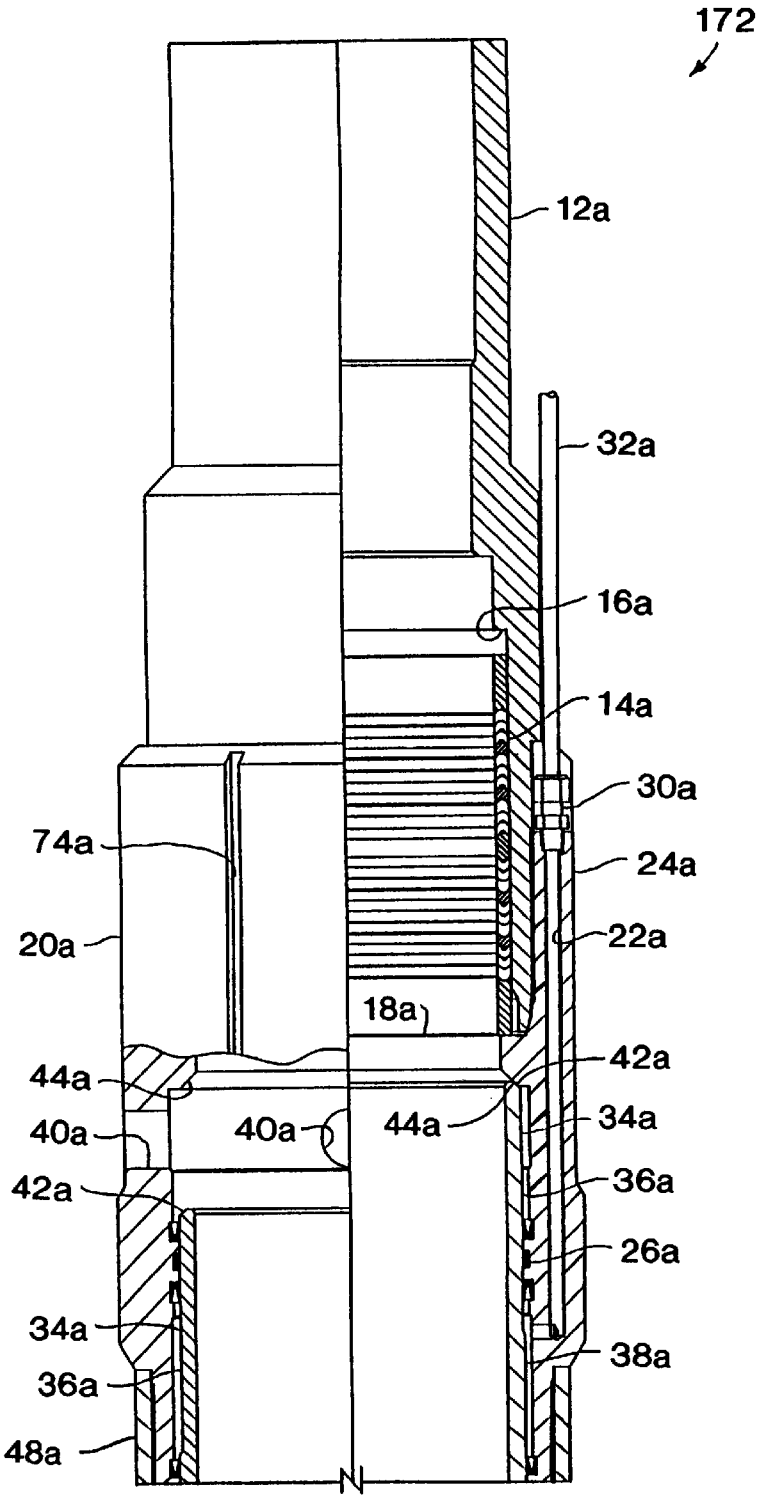
FIGS. 4A–4B are partially cross-sectional and partially elevational views of successive axial portions of a second annular safety valve embodying principles of the present invention.
Figure 4B:
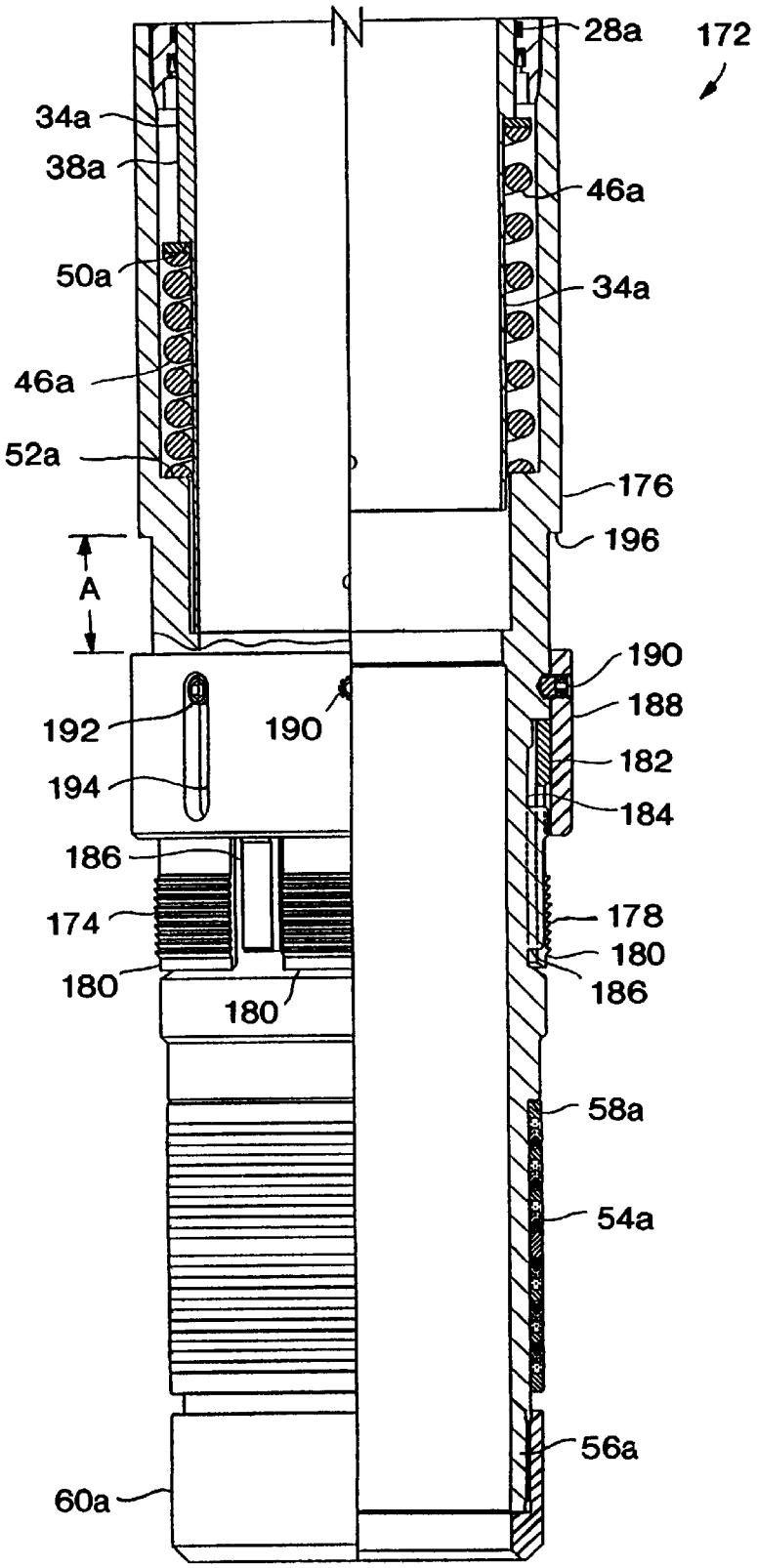

Referring additionally now to FIGS. 4A–4B, the replacement retrievable annular safety valve 172 is representatively illustrated. Although the safety valve 172 is shown in separate figures for convenience, it is to be understood that it is actually a continuous assembly. Elements of the safety valve which are similar to those previously described of the safety valve 10 are indicated in FIGS. 4A–4B utilizing the same reference numbers, with an added suffix "a".

In large part, the replacement safety valve 172 differs from the safety valve 10 structurally in and about its threaded member 174. Whereas the safety valve 10 has threads 62 formed directly on its outer housing 48, the safety valve 172 has the threaded member 174 disposed exteriorly and substantially circumferentially about its outer housing 176. Threads 178, formed exteriorly on the threaded member 174 are, however, similar to the threads 62, in that they are complementarily shaped with respect to the threads 86 on the packer 76 and are preferably of the left-hand buttress type.

The threaded member 174 has its threads 178 formed on a series of axially downwardly extending and circumferentially spaced apart fingers 180. The fingers 180 are radially inwardly and outwardly deflectable and are preferably resilient. An upper portion 182 of the threaded member 174 is generally tubular, and a lateral cross-section thereof is generally C-shaped, so that the threaded member may be radially outwardly expanded for installation onto the outer housing 176.

The threaded member 174 is positioned in a radially reduced portion 184 of the outer housing 176. A series of radially outwardly extending and circumferentially spaced apart splines 186 are formed on the outer housing 176 such that each of the splines is radially between a corresponding pair of the fingers 180. In this manner, the threaded member is prevented from rotating substantially relative to the outer housing 176.

When the safety valve 172 is conveyed into the wellbore and operatively engaged with the packer 76, the threaded member 174 contacts the threads 86 of the packer, and the "ramps" of the mating threads cause the fingers 180 of the threaded member to radially inwardly retract, thereby permitting the safety valve to further axially engage the packer 76. As each turn of the threads 178, 86 axially pass each other, the fingers 180 alternately radially inwardly displace, and then resiliently spring back into engagement with the mating threads. When the safety valve 172 is completely operatively engaged with the packer 76, the packing 14a sealingly engages the inner mandrel 78, the packing 54*a* sealingly engages the upper housing 82, and the threads 178 engage the threads 86. Fluid pressure may then be applied to the control line 32*a* to operate the safety valve 172.

In yet another unique feature of the present invention, the safety valve 172 has a generally tubular collar 188 disposed axially slidingly and exteriorly on the outer housing 176. The collar 188 is releasably prevented from axially displacing relative to the outer housing 176 by a series of four shear screws 190 (only two of which are visible in FIG. 4B) extending radially through the collar and partially into the outer housing. A screw 192 is disposed radially through an axially extending slot 194 formed on the collar and threaded partially into the outer housing 176, so that the collar 188 will not separate from the safety valve 172 if it is later retrieved from the wellbore separate from the packer 76.

When the safety valve 172 is brought into axial contact with the packer 76 as the safety valve is lowered within the wellbore, the collar 188 axially contacts the packer upper housing 82 before the threads 86, 178 engage. In this manner, an operator at the earth's surface will receive an indication that the safety valve 172 has contacted the packer 76, due to a decreased weight indication on a rig weight gauge. An axial distance A from the collar 188 to a shoulder 196 externally formed on the outer housing 176 being known, the operator can appropriately calculate where the upper tubing string will be positioned when the safety valve 172 is completely operatively engaged with the packer 76 and can space out the tubing and associated tree at the earth's surface.

When the tubing string and tree are appropriately spaced out at the earth's surface, the operator may lower the upper tubing string to again bring the collar 188 into axial contact with the upper housing 82, and then may apply sufficient weight to the safety valve to shear the shear screws 190. The safety valve 172 may then axially downwardly displace relative to the packer 76, thereby permitting the threads 178, 86 to engage.

Figure 5:
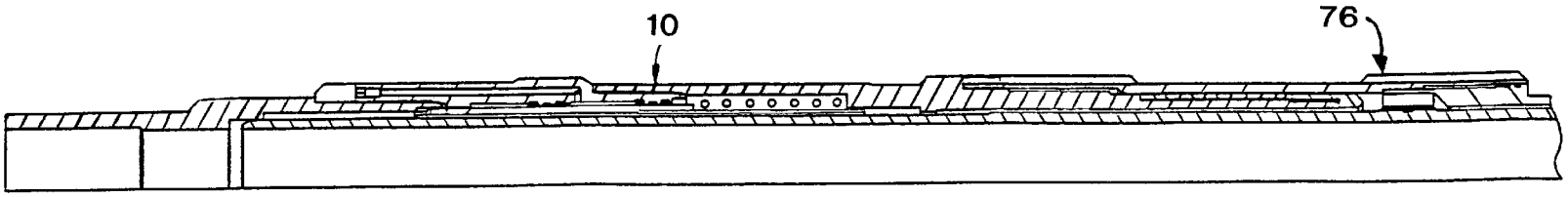
FIGS. 5–8 are quarter-sectional views of the retrievable annular safety valve system, FIG. 5 showing the first annular safety valve operatively installed in the packer, FIG. 6 showing the first annular safety valve disengaged and retrieved from the packer, FIG. 7 showing the second annular safety valve in a delay position with respect to the packer, and FIG. 8 showing the second annular safety valve operatively installed in the packer.
Figure 6:
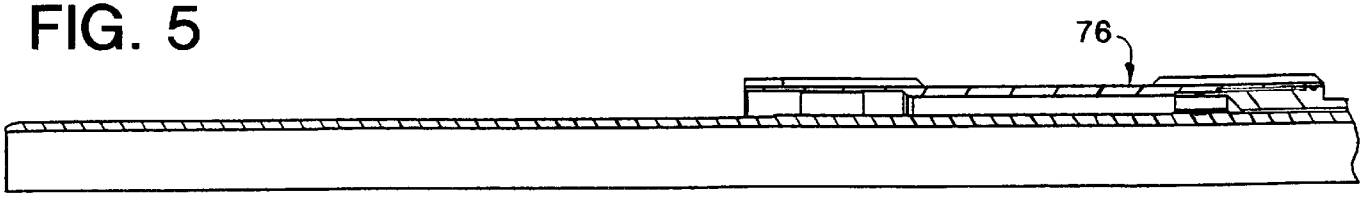
Figure 7:
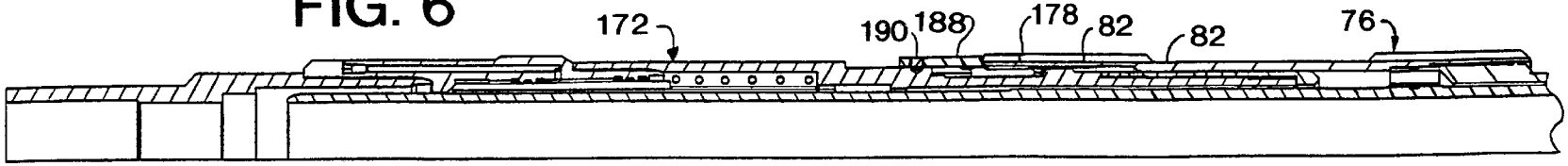
Figure 8:
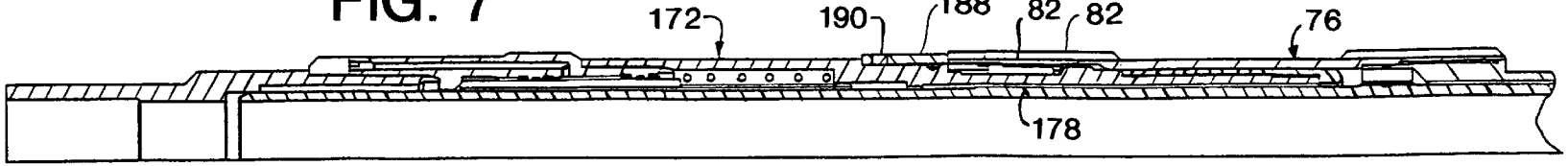

FIGS. 5–8 representatively and schematically illustrate the above-described sequence of running the safety valve 10 and packer 76, retrieving the safety valve 10, running the replacement safety valve 172, and operatively engaging the replacement safety valve with the packer 76. FIG. 5 shows the retrievable annular safety valve 10 operatively engaged with the packer 76, a lower axial portion of the packer not being shown for illustrative convenience. FIG. 6 shows the packer 76 set in the wellbore, with the safety valve 10 disengaged therefrom and retrieved to the earth's surface. FIG. 7 shows the replacement safety valve 172 being lowered into the wellbore, with the collar 188 axially contacting the upper housing 82. Note that, at this point, the threads 86, 178 are not engaged, enabling the safety valve 172 to be raised for spacing out of the upper tubing string and tree at the earth's surface. FIG. 8 shows the safety valve 172 operatively engaged with the packer 76, the shear screws 190 having been sheared by application of sufficient axial force to the safety valve while the collar 188 contacts the upper housing 82. The threads 86, 178 are now engaged and the safety valve 172 may be operated as described hereinabove.

If subsequent retrieval of the replacement safety valve 172 is desired, it may be retrieved following the procedure described hereinabove for retrieval of the safety valve 10. Specifically, the safety valve 172 may be rotated to the right by rotating the upper tubing string at the earth's surface while applying an upwardly directed force to the safety valve to thereby disengage the threads 86, 178. When the threads 86, 178 are completely disengaged, the safety valve 172 may be retrieved from the well. Note that it is important to apply an upwardly directed force to the safety valve 172 while rotating it to disengage the threads 86, 178, since otherwise, the fingers 180 will continue to alternately radially inwardly retract away from, and engage, the threads 86.

Figure 9A:
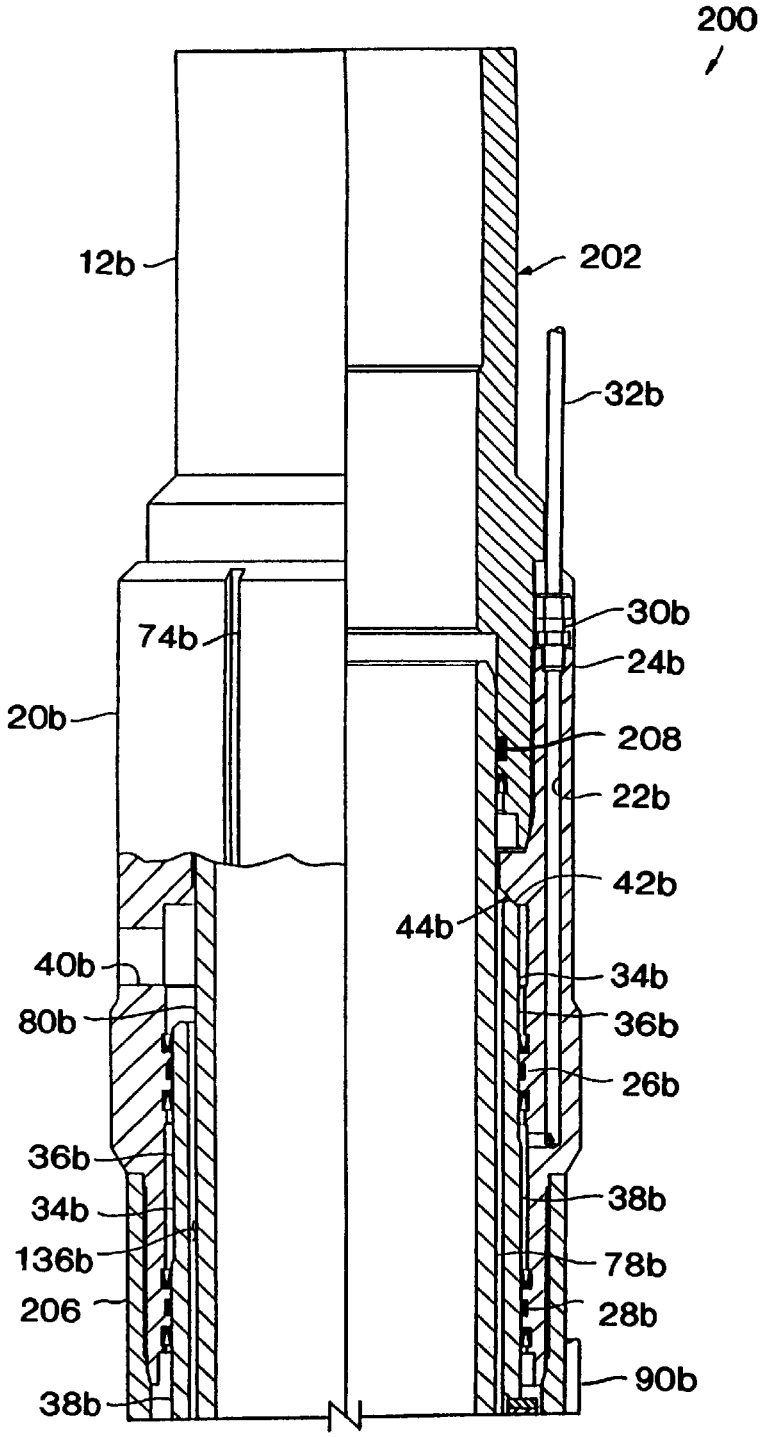
FIGS. 9A–9B are partially cross-sectional and partially elevational views of successive axial portions of a retrievable annular safety valve system embodying principles of the present invention.
Figure 9B:
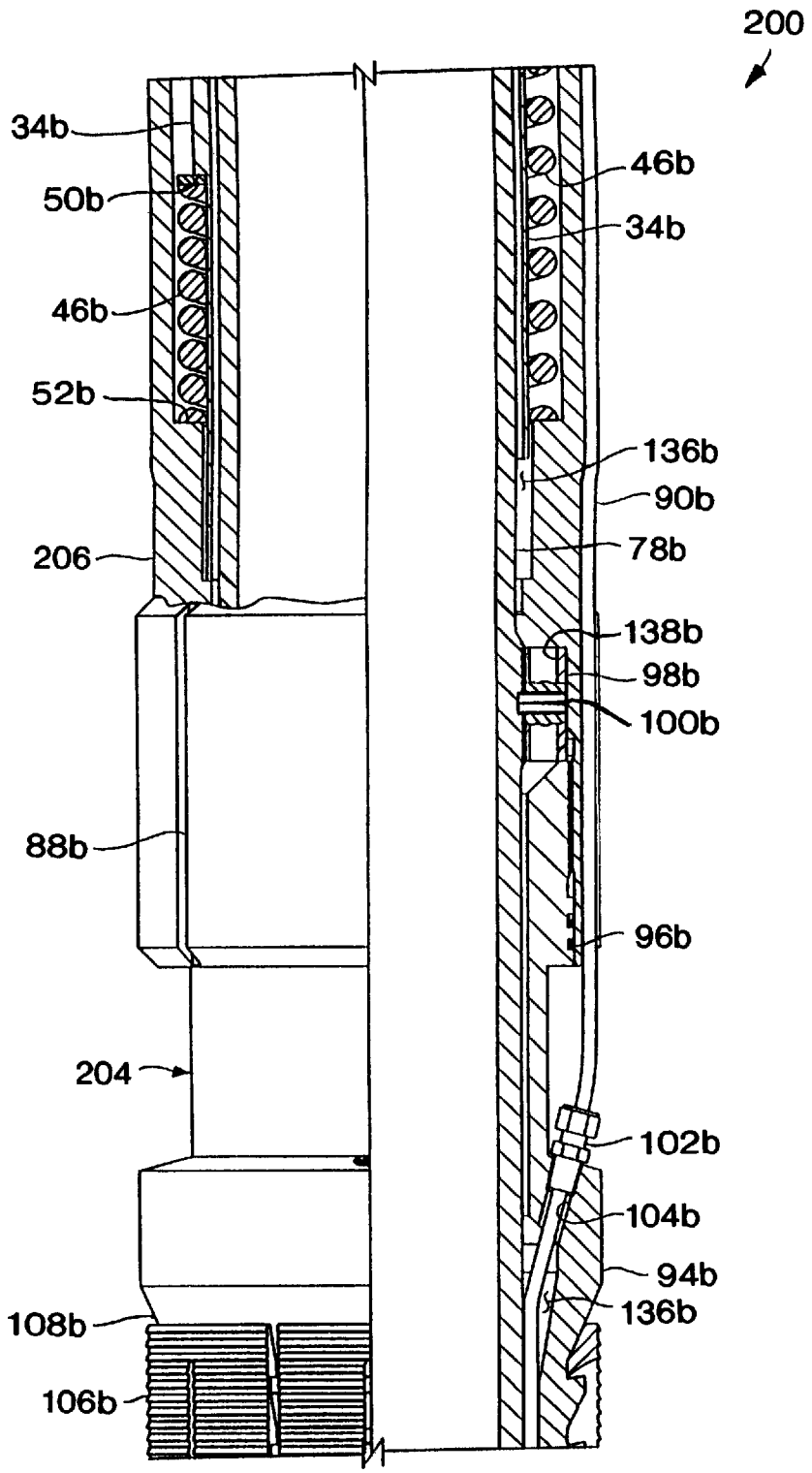

Referring additionally now to FIGS. 9A and 9B, another annular safety valve system 200 is representatively illustrated, the system embodying principles of the present invention. Although the system 200 is shown in separate figures, it is to be understood that it is a continuous assembly. Elements of the safety valve system 200 which are similar to previously described elements of the safety valve 10 and packer 76 are indicated in FIGS. 9A and 9B utilizing the same reference numerals, with an added suffix "b".

The system 200 differs from the system 170 representatively illustrated in FIGS. 3A–3F in large part in that its annular safety valve portion 202 and packer portion 204 are combined into a single assembly which is retrievable as a unit, the safety valve portion 202 not being designed for retrieval separate from the packer portion 204. For this purpose, in place of the separate outer housing 48 and upper housing 82 of the system 170, the system 200 utilizes an axially extending and generally tubular outer housing 206. The outer housing 206 is threadedly attached to the piston housing 20*b* and extends axially downward therefrom. The outer housing 206 is also threadedly attached to the intermediate housing 94*b*.

Note that, in place of the packing 14, a circumferential seal 208 is preferably utilized in the top sub 12*b* for sealing engagement with the inner mandrel 78*b*. The packing 54 is eliminated, since there are no separate outer and upper housings 48, 82 between which sealing engagement is required. Note also, that a lower axial portion of the packer portion 204 is not shown in FIGS. 9A and 9B, since, axially downward from the outer housing 206, the packer portion is substantially the same as the packer 76 shown in FIGS. 2A–2D.

The system 200 is provided for use in those circumstances in which separate retrieval of the safety valve portion 202 is not anticipated. For these circumstances, it is projected by applicant that the system 200 will be more economical to manufacture, inventory, assemble, etc. than the system 170, due to the fewer number of parts. Where, however, it is desired to retrieve the system 200 from the well after the packer portion 204 has been set in the wellbore, the packer portion 204 may be conveniently unset utilizing the methods described hereinabove for unsetting the packer 76. Specifically, the inner mandrel 78*b* may be cut by a chemical cutter, fluid jet, explosive cutter, etc., thereby permitting radially inward retraction of the slips and seal elements, and permitting retrieval of the system 200 from the well. Other than the above-described differences, the system 200 functions similar to the system 170.

Thus have been described the retrievable annular safety valve 10, packer 76, system 170, replacement safety valve 172, and system 200 embodying principles of the present invention. The system 170 does not require the entire tubing string to be raised in order to retrieve the safety valve 10. The system 170 is provided with a control line set packer 76 which releasably connects to the safety valve 10, so that the advantages of a hydraulically set packer are acquired without the need for ports in the packer's inner mandrel 78. The system 170 is also provided with provision for connection and disconnection of fluid conduits, electrical connections, etc. from above to below the packer 76, so that pressure gauges, temperature gauges, and other instruments installed below the packer may be in communication with the earth's surface. Furthermore, in the system 170, the packer 76 is easily retrievable apart from, or in conjunction with, the safety valve 10 or 172. Additionally, the system 200 provides the annular safety valve portion 202 and packer portion 204 as a unitized retrievable assembly.

Of course, modifications may be made to the above described retrievable annular safety valve 10, packer 76, system 170, replacement safety valve 172, system 200, or any one of them, by a person having ordinary skill in the art. All such modifications are encompassed by the principles of the present invention. Accordingly, the foregoing detailed description is to be clearly understood as being given by way of illustration and example only, the spirit and scope of the present invention being limited solely by the appended claims.

What is claimed is:

1. Apparatus for utilization in a subterranean wellbore, the apparatus comprising:

a packer portion, the packer portion being configured for attachment to a first tubular string and having a seal portion selectively operable to sealingly engage the wellbore in a manner preventing axial fluid flow between the packer portion and the wellbore; and a valve portion, the valve portion being configured for attachment to a second tubular string, the valve portion being releasably attached to the packer portion and including a flow control member movable to selectively permit fluid flow from a first annulus disposed radially between the valve portion and the wellbore, and a second annulus disposed radially between the first tubular string and the wellbore.

2. Apparatus for utilization in a subterranean wellbore, the apparatus comprising:

a packer portion, the packer portion being configured for attachment to a first tubular string and having a seal portion selectively operable to sealingly engage the wellbore in a manner preventing axial fluid flow between the packer portion and the wellbore; and a valve portion, the valve portion being configured for attachment to a second tubular string, the valve portion being releasably attached to the packer portion and including a flow control member movable to selectively permit fluid flow from a first annulus disposed radially between the valve portion and the wellbore, and a second annulus disposed radially between the first tubular string and the wellbore, the valve portion being threadedly attached to the second tubular string at a first threaded connection therebetween, wherein the valve portion is threadedly attached to the packer portion at a second threaded connection therebetween, and wherein the first and second threaded connections are of opposite hands.

3. The apparatus according to claim 1, wherein the packer portion includes a generally tubular and axially extending mandrel, and wherein the valve portion sealingly engages the mandrel when the valve portion is attached to the packer portion.

4. The apparatus according to claim 3, wherein the valve portion includes a circumferential seal, the circumferential seal being capable of slidingly and sealingly engaging the mandrel.

5. The apparatus according to claim 1, wherein the valve portion is capable of being retrieved from the wellbore by axially rotating the valve portion relative to the packer portion to thereby release the valve portion from the packer portion.

6. Apparatus for utilization in a subterranean wellbore, the apparatus comprising:

a packer portion, the packer portion being configured for attachment to a first tubular string and having a seal portion selectively operable to sealingly engage the wellbore in a manner preventing axial fluid flow between the packer portion and the wellbore; and a valve portion, the valve portion being configured for attachment to a second tubular string, the valve portion being releasably attached to the packer portion and including a flow control member movable to selectively permit fluid flow from a first annulus disposed radially between the valve portion and the wellbore, and a second annulus disposed radially between the first tubular string and the wellbore, the packer portion being settable within the wellbore by application of fluid pressure from the earth's surface to the packer portion via a packer setting line in fluid communication with the packer portion and extending to the earth's surface.

7. The apparatus according to claim 6, wherein the packer setting line is disconnectable between the packer portion and the valve portion by axially rotating the valve portion relative to the packer portion.

8. The apparatus according to claim 7, wherein the valve portion includes a blade having a cutting edge being positioned to engage and sever the packer setting line when the valve portion is axially rotated relative to the packer portion.

9. Apparatus for utilization in a subterranean wellbore, the apparatus comprising:

a packer portion, the packer portion being configured for attachment to a first tubular string and having a seal portion selectively operable to sealingly engage the wellbore in a manner preventing axial fluid flow between the packer portion and the wellbore;

a valve portion, the valve portion being configured for attachment to a second tubular string, the valve portion being releasably attached to the packer portion and including a flow control member movable to selectively permit fluid flow from a first annulus disposed radially between the valve portion and the wellbore, and a second annulus disposed radially between the first tubular string and the wellbore; and a transmission line extending axially proximate the valve portion and the packer portion through an opening formed therein, and wherein the valve portion includes a cutting edge positioned to engage and cut through the transmission line when the valve portion is displaced relative to the packer portion.

10. The apparatus according to claim 9, wherein the packer portion includes a plurality of the openings circumferentially spaced apart on the packer portion, and wherein the valve portion includes a plurality of the cutting edges circumferentially spaced apart on the valve portion.

11. The apparatus according to claim 10, wherein the quantity of the openings is different from the quantity of the cutting edges.

12. The apparatus according to claim 1, wherein the packer portion includes a generally tubular and axially extending inner mandrel, and wherein the packer portion is configured to be retrievable from the wellbore, after the packer portion has been set in the wellbore, subsequent to axially parting the inner mandrel.

13. The apparatus according to claim 12, wherein the inner mandrel is secured against axial displacement relative to a first opposite end of the packer portion, and wherein the inner mandrel is securable against axial displacement in one direction relative to a second opposite end of the packer portion by a slip member of the packer portion.

14. The apparatus according to claim 13, wherein the inner mandrel is axially slidingly and sealingly disposed relative to a piston of the packer portion, the piston being axially displaceable relative to the first opposite end to selectively set the packer portion in the wellbore.

15. The apparatus according to claim 14, wherein the slip member is axially secure relative to the piston, the slip member axially displacing with the piston when the packer portion is set in the wellbore.

16. An annular safety valve for use in conjunction with a packer, the packer being settable within a subterranean wellbore and having a first sealing surface and a first axial engagement surface formed thereon, the packer further having inner and outer diameters and a first axially extending fluid passage formed radially between the inner and outer diameters, the annular safety valve comprising:

a second sealing surface, the second sealing surface being configured for cooperative sealing engagement with the first sealing surface;

a second axial engagement surface positioned to axially engage the first axial engagement surface when the second sealing surface sealingly engages the first sealing surface; and a second fluid passage positioned to be in fluid communication with the first fluid passage when the second sealing surface sealingly engages the first sealing surface.

17. The annular safety valve according to claim 16, wherein the packer further has a third sealing surface, and wherein the annular safety valve further comprises a fourth sealing surface positioned to sealingly engage the third sealing surface when the second sealing surface sealingly engages the first sealing surface.

18. The annular safety valve according to claim 16, wherein the first axial engagement surface is formed on a first threaded member of the packer, and wherein the annular safety valve further comprises a second threaded member complementarily shaped relative to the first threaded member.

19. The annular safety valve according to claim 18, wherein the second threaded member includes a series of circumferentially spaced apart and axially elongated fingers formed thereon.

20. The annular safety valve according to claim 19, wherein the fingers are configured to be radially displaced in a manner permitting axial engagement of the first and second threaded members.

21. The annular safety valve according to claim 16, wherein the packer has a surface formed thereon, and wherein the annular safety valve further comprises an abutment member slidingly disposed relative to the second axial engagement surface, the abutment member being positioned to contact the packer surface before the second axial engagement surface axially engages the first axial engagement surface.

22. The annular safety valve according to claim 21, further comprising a shear member having a predetermined shear strength, the shear member releasably securing the abutment member against sliding displacement relative to the second axial engagement member, and the shear member being configured to shear, to thereby permit engagement of the first axial engagement surface with the second axial engagement surface, when the abutment member contacts the packer surface and a force greater than the shear strength is applied to the shear member.

* * * * *